US009885130B2

(12) United States Patent
Yenici et al.

(10) Patent No.: US 9,885,130 B2
(45) Date of Patent: Feb. 6, 2018

(54) WOVEN FABRIC THAT LOOKS AND PERFORMS LIKE A KNITTED FABRIC AND METHOD OF MAKING THEREOF

(75) Inventors: Hamit Yenici, Göynüklü/Mudanya/Bursa (TR); Fatma Korkmaz, Nilufür/Bursa (TR); Ertug Erkus, Nilufür/Bursa (TR); Ahmet Udul, Inegöl/Bursa (TR)

(73) Assignee: SANKO TEKSTIL ISLETMELERI SANAYI VE, Inegol Bursa (TR)

( * ) Notice: Subject to any disclaimer, the term of this patent is extended or adjusted under 35 U.S.C. 154(b) by 963 days.

(21) Appl. No.: 13/580,172

(22) PCT Filed: Feb. 24, 2011

(86) PCT No.: PCT/EP2011/000902
§ 371 (c)(1),
(2), (4) Date: Oct. 16, 2012

(87) PCT Pub. No.: WO2011/104022
PCT Pub. Date: Sep. 1, 2011

(65) Prior Publication Data
US 2013/0048140 A1 Feb. 28, 2013

Related U.S. Application Data

(63) Continuation-in-part of application No. 12/778,547, filed on May 12, 2010.
(Continued)

(51) Int. Cl.
*D03D 15/04* (2006.01)
*D03D 15/08* (2006.01)
(Continued)

(52) U.S. Cl.
CPC ..... *D03D 15/04* (2013.01); *D03D 15/08* (2013.01); *D03D 17/00* (2013.01); *D03D 27/04* (2013.01); *Y10T 442/3024* (2015.04)

(58) Field of Classification Search
CPC ..... D03D 15/04; D03D 15/08; D03D 17/00; D03D 7/00; D03D 13/002; D03D 13/004;
(Continued)

(56) References Cited

U.S. PATENT DOCUMENTS 1,672,186 A * 6/1928 Wilson ..... D03D 15/08 139/421
1,965,248 A * 7/1934 Moore ..... D03D 15/08 139/419
(Continued)

FOREIGN PATENT DOCUMENTS

BE WO2004099478 A1 † 11/2004
CH 344686 A 2/1960
(Continued)

OTHER PUBLICATIONS

English Language Translation of DE 3247651 (Aug. 1984), 15 pages.*
(Continued)

*Primary Examiner* — Amy Vanatta
(74) *Attorney, Agent, or Firm* — Sughrue Mion, PLLC

(57) ABSTRACT

A fabric with wefts that include hard yarns and elastomeric yarns in a predetermined arrangement such that at least one hard yarn is alternately arranged with at least one elastomeric yarn, the elastomeric yarns having a greater shrinkage ratio than that of the hard yarns; the hard yarns form under portions and over portions with respect to warps, the under portions being formed when the hard yarns pass along the back side of the warps and defining loop portions, and the over portions being formed when the hard yarns pass along
(Continued)

the front side of the warps and define connection portions, wherein for each hard yarn, the number of warps passed by the loop portion is at least 6, and the elastomeric yarns form under portions and over portions with respect to the warps in a weave that is tighter than the weave of the hard yarns.

42 Claims, 15 Drawing Sheets

Related U.S. Application Data

(60) Provisional application No. 61/308,724, filed on Feb. 26, 2010.

(51) Int. Cl.
*D03D 17/00* (2006.01)
*D03D 27/04* (2006.01)

(58) Field of Classification Search
CPC ..... D03D 27/04; D03D 2700/0103; D03D 2700/0133; D03D 2700/0137; Y10T 442/3024; D06C 7/00; D06C 7/02
USPC .... 139/383 R, 420 R, 421, 422, 423, 426 R, 139/420 A, 383 B; 28/156, 165
See application file for complete search history.

(56) References Cited

U.S. PATENT DOCUMENTS

| | | | | |
|---|---|---|---|---|
| 2,254,339 | A | 9/1941 | Wylde et al. | |
| 2,268,809 | A | 1/1942 | De Roon | |
| 2,330,645 | A * | 9/1943 | Voegeli | D03D 11/00 139/408 |
| 2,597,580 | A | 5/1952 | Gluck | |
| 2,809,673 | A * | 10/1957 | McMurray | D03D 23/00 139/423 |
| 2,810,281 | A | 10/1957 | Appleton et al. | |
| 3,479,245 | A | 11/1969 | Manock | |
| 4,234,022 | A | 11/1980 | Okamoto et al. | |
| 4,283,194 | A | 8/1981 | Teague et al. | |
| 4,676,278 | A | 6/1987 | Dutt | |
| 4,714,096 | A * | 12/1987 | Guay | A44B 18/0034 139/391 |
| 4,739,803 | A * | 4/1988 | Borel | D21F 1/0045 139/383 A |
| 4,892,539 | A | 1/1990 | Koch | |
| 5,054,524 | A | 10/1991 | Kato et al. | |
| 5,067,400 | A | 11/1991 | Bezella et al. | |
| 5,645,924 | A | 7/1997 | Hamilton | |
| 5,749,400 | A | 5/1998 | Pascual | |
| 5,837,622 | A | 11/1998 | Hamilton et al. | |
| 5,858,885 | A | 1/1999 | Hamilton et al. | |
| 6,666,235 | B2 | 12/2003 | Chi et al. | |
| 6,752,840 | B1 | 6/2004 | Onishi et al. | |
| 6,918,413 | B2 | 7/2005 | Ono et al. | |
| 7,299,828 | B2 | 11/2007 | Liao | |
| 7,310,932 | B2 | 12/2007 | Liao | |
| 7,836,918 | B1 † | 11/2010 | Osborne | |
| 2006/0179810 | A1 | 8/2006 | Liao | |
| 2008/0096001 | A1 | 4/2008 | Emden et al. | |
| 2008/0268734 | A1 † | 10/2008 | Tharpe | |
| 2009/0126057 | A1 | 5/2009 | Rock et al. | |
| 2009/0191777 | A1 | 7/2009 | Liao | |
| 2010/0093258 | A1 | 4/2010 | Glenn et al. | |
| 2010/0248574 | A1 † | 9/2010 | King | |
| 2015/0133017 | A1 * | 5/2015 | Liao | D03D 15/08 |
| 2015/0159320 | A1 * | 6/2015 | Lau | D06N 3/0006 442/59 |

FOREIGN PATENT DOCUMENTS

| | | | | |
|---|---|---|---|---|
| CN | 2091299 | U | 12/1991 | |
| CN | 101328635 | A | 12/2008 | |
| DE | 1757093 | U | 11/1957 | |
| DE | 7013604 | U | 7/1970 | |
| DE | 3247651 | | 8/1984 | |
| DE | 68911941 | T2 | 5/1994 | |
| DE | 4444825 | A1 | 6/1995 | |
| EP | 0327903 | A2 | 8/1989 | |
| EP | 1676944 | A1 | 7/2006 | |
| EP | 2019159 | A1 | 1/2009 | |
| GB | 308849 | | 4/1929 | |
| GB | 409273 | A | 4/1934 | |
| GB | 512578 | A | 9/1939 | |
| JP | S61282453 | A | 12/1986 | |
| JP | H11181649 | A | 7/1999 | |
| JP | 2001295152 | A | 10/2001 | |
| JP | 2002302845 | A | 10/2002 | |
| JP | 3104242 | U | 9/2004 | |
| JP | 2005179796 | A | 7/2005 | |
| JP | 2009-97107 | A | 5/2009 | |
| JP | 2011511888 | A | 4/2011 | |
| WO | WO 2004099478 | A1 * | 11/2004 | D03D 11/02 |
| WO | 2007118672 | A1 | 10/2007 | |

OTHER PUBLICATIONS

Notification of a Submission of Information dated Mar. 28, 2014, received Apr. 11, 2014, issued in corresponding Japanese Application No. 2012-554247.
English Translation of Japanese Office Action dated Mar. 28, 2014, received Apr. 11, 2014, issued in corresponding Japanese Application No. 2012-554247.
Notice of Opposition to a European Patent dated Nov. 5, 2015 in counterpart application No. 11706485.7.
Specification sheet of FAENZA fabric of Jul. 11, 2007 (2 pages).
Specification sheet of arrangement of warping and weaving of FAENZA fabric of Nov. 27, 2007 (1 page).
E-mail correspondence between Lan. Europaand Linset Tekstil of Mar. 9-10, 2008 (1 page).
E-mail correspondence between Lan. Europaand Linset Tekstil of Mar. 12, 2008 (1 page).
Order proposal No. 10347 by Lan. Europato Linset Teksil regarding FAENZA fabric and others of Mar. 14, 2008 (1 page).
Specification sheet of FEP/PL fabric of Jul. 16, 2007 (3 pages).
Specification sheet of arrangement of warp and weft of FEP/PL fabric of Nov. 6, 2007 (1 page).
Written declaration of the facts signed by Luigi Guarducci, chairman and CEO of Lan. Europa (1 page).
Book. "Large Book of textile designs" Franz Donat, 1895 (5 pages).
Book: "Tessuti a licci", Giacomo Airoldi, 1981 (3 pages).
Book: "Il tessuto ordito e trama ad intreccio ortogonale", Giacomo Airoldi, 2000 (4 pages).
Book: "Tecnologia Tessile—Fibre—Filati—Tessuti", Giorgio Moreschi, 1968 (6 pages).
Pile Weaves, International Textbook Co., 1905, 36 pages.
ACP Composites, Woven Fabric Selection Guide downloaded from http://wwvv.acpsales.com/Woven-Fabric-Style-Guide.html on Aug. 15, 2016.
Intervention in Opposition against EP 253493 B1, Peek et al., Dec. 9, 2016.
Intervention in Opposition against EP 2539493 B1, BRAX Store GmbH, et al., Sep. 21, 2016.
Notice of Opposition against EP 20110706485 B1, S. Mensucat, Feb. 19, 2016.
Notice of Opposition against EP 2539493 B1, Wolfgang Mordhorst, Feb. 22, 2016.
Intervention in Opposition against EP 2539493 B1, Calik Denim Tekstil San. ve Tic. A.S., Jun. 9, 2016.
Intervention in Opposition against EP 2539493 B1, Abercrombie & Fitch Stores, Inc., Nov. 8, 2016.
Intervention in Opposition against EP 2539493 B1, Adidas AG, Jun. 23, 2016.

(56) References Cited

OTHER PUBLICATIONS

Cay et al.; Effects of Warp-Weft Density Variation and Fabric Porosity of the Cotton Fabrics on their Colour in Reactive Dyeing; Fibres & Textiles, Jan./Mar. 2007, vol. 15, No. 1 (60), pp. 91-94.

* cited by examiner
† cited by third party

FIG. 6

| | | | | | | | | | | | | | | | |
|---|---|---|---|---|---|---|---|---|---|---|---|---|---|---|---|
| PICK 36 | 1 | ■ | | ■ | ■ | | ■ | ■ | | ■ | ■ | | ■ | 1 | 70 DEN pes lycra |
| PICK 35 | 2 | | ■ | ■ | | ■ | ■ | | ■ | ■ | | ■ | ■ | 1 | 70 DEN pes lycra |
| PICK 34 | 3 | ■ | ■ | ■ | | ■ | ■ | ■ | ■ | ■ | ■ | ■ | ■ | 2 | 50/1 NE COTTON |
| PICK 33 | 1 | ■ | ■ | | ■ | ■ | | ■ | ■ | | ■ | ■ | | 1 | 70 DEN pes lycra |
| PICK 32 | 2 | ■ | | ■ | ■ | | ■ | ■ | | ■ | ■ | | ■ | 1 | 70 DEN pes lycra |
| PICK 31 | 3 | ■ | ■ | ■ | ■ | ■ | ■ | ■ | ■ | ■ | ■ | | ■ | 2 | 50/1 NE COTTON |
| PICK 30 | 1 | | ■ | ■ | | ■ | ■ | | ■ | ■ | | ■ | ■ | 1 | 70 DEN pes lycra |
| PICK 29 | 2 | ■ | ■ | | ■ | ■ | | ■ | ■ | | ■ | ■ | | 1 | 70 DEN pes lycra |
| PICK 28 | 3 | ■ | ■ | ■ | ■ | ■ | | ■ | ■ | ■ | ■ | ■ | ■ | 2 | 50/1 NE COTTON |
| PICK 27 | 1 | ■ | | ■ | ■ | | ■ | ■ | | ■ | ■ | | ■ | 1 | 70 DEN pes lycra |
| PICK 26 | 2 | | ■ | ■ | | ■ | ■ | | ■ | ■ | | ■ | ■ | 1 | 70 DEN pes lycra |
| PICK 25 | 3 | | ■ | ■ | ■ | ■ | ■ | ■ | ■ | ■ | ■ | ■ | ■ | 2 | 50/1 NE COTTON |
| PICK 24 | 1 | ■ | ■ | | ■ | ■ | | ■ | ■ | | ■ | ■ | | 1 | 70 DEN pes lycra |
| PICK 23 | 2 | ■ | | ■ | ■ | | ■ | ■ | | ■ | ■ | | ■ | 1 | 70 DEN pes lycra |
| PICK 22 | 3 | ■ | ■ | ■ | ■ | ■ | ■ | ■ | | ■ | ■ | ■ | ■ | 2 | 50/1 NE COTTON |
| PICK 21 | 1 | | ■ | ■ | | ■ | ■ | | ■ | ■ | | ■ | ■ | 1 | 70 DEN pes lycra |
| PICK 20 | 2 | ■ | ■ | | ■ | ■ | | ■ | ■ | | ■ | ■ | | 1 | 70 DEN pes lycra |
| PICK 19 | 3 | ■ | ■ | | ■ | ■ | ■ | ■ | ■ | ■ | ■ | ■ | ■ | 2 | 50/1 NE COTTON |
| PICK 18 | 1 | ■ | | ■ | ■ | | ■ | ■ | | ■ | ■ | | ■ | 1 | 70 DEN pes lycra |
| PICK 17 | 2 | | ■ | ■ | | ■ | ■ | | ■ | ■ | | ■ | ■ | 1 | 70 DEN pes lycra |
| PICK 16 | 3 | ■ | ■ | ■ | ■ | ■ | ■ | ■ | ■ | ■ | | ■ | ■ | 2 | 50/1 NE COTTON |
| PICK 15 | 1 | ■ | ■ | | ■ | ■ | | ■ | ■ | | ■ | ■ | | 1 | 70 DEN pes lycra |
| PICK 14 | 2 | ■ | | ■ | ■ | | ■ | ■ | | ■ | ■ | | ■ | 1 | 70 DEN pes lycra |
| PICK 13 | 3 | ■ | ■ | ■ | ■ | | ■ | ■ | ■ | ■ | ■ | ■ | ■ | 2 | 50/1 NE COTTON |
| PICK 12 | 1 | | ■ | ■ | | ■ | ■ | | ■ | ■ | | ■ | ■ | 1 | 70 DEN pes lycra |
| PICK 11 | 2 | ■ | ■ | | ■ | ■ | | ■ | ■ | | ■ | ■ | | 1 | 70 DEN pes lycra |
| PICK 10 | 3 | ■ | ■ | ■ | ■ | ■ | ■ | ■ | ■ | ■ | ■ | ■ | | 2 | 50/1 NE COTTON |
| PICK 9 | 1 | ■ | | ■ | ■ | | ■ | ■ | | ■ | ■ | | ■ | 1 | 70 DEN pes lycra |
| PICK 8 | 2 | | ■ | ■ | | ■ | ■ | | ■ | ■ | | ■ | ■ | 1 | 70 DEN pes lycra |
| PICK 7 | 3 | ■ | ■ | ■ | ■ | ■ | ■ | | ■ | ■ | ■ | ■ | ■ | 2 | 50/1 NE COTTON |
| PICK 6 | 1 | ■ | ■ | | ■ | ■ | | ■ | ■ | | ■ | ■ | | 1 | 70 DEN pes lycra |
| PICK 5 | 2 | ■ | | ■ | ■ | | ■ | ■ | | ■ | ■ | | ■ | 1 | 70 DEN pes lycra |
| PICK 4 | 3 | ■ | | ■ | ■ | ■ | ■ | ■ | ■ | ■ | ■ | ■ | ■ | 2 | 50/1 NE COTTON |
| PICK 3 | 1 | | ■ | ■ | | ■ | ■ | | ■ | ■ | | ■ | ■ | 1 | 70 DEN pes lycra |
| PICK 2 | 2 | ■ | ■ | | ■ | ■ | | ■ | ■ | | ■ | ■ | | 1 | 70 DEN pes lycra |
| PICK 1 | 3 | ■ | ■ | ■ | ■ | ■ | ■ | ■ | ■ | | ■ | ■ | ■ | 2 | 50/1 NE COTTON |
| | | W1 | W2 | W3 | W4 | W5 | W6 | W7 | W8 | W9 | W10 | W11 | W12 | | |

FIG. 8

| | | | | | | | | | | | | | | | |
|---|---|---|---|---|---|---|---|---|---|---|---|---|---|---|---|
| PICK 36 | | | ■ | ■ | ■ | | ■ | ■ | ■ | | ■ | ■ | ■ | 1 | 70 DEN pes lycra |
| PICK 35 | | ■ | ■ | ■ | ■ | ■ | ■ | ■ | ■ | | ■ | ■ | ■ | 2 | NE 50/1 COTTON |
| PICK 34 | | ■ | ■ | ■ | ■ | ■ | ■ | ■ | ■ | | ■ | ■ | ■ | 2 | NE 50/1 COTTON |
| PICK 33 | | ■ | | ■ | ■ | ■ | | ■ | | ■ | ■ | ■ | | 1 | 70 DEN pes lycra |
| PICK 32 | | ■ | | ■ | ■ | ■ | ■ | ■ | ■ | ■ | ■ | ■ | ■ | 2 | NE 50/1 COTTON |
| PICK 31 | | ■ | | ■ | ■ | ■ | ■ | ■ | ■ | ■ | ■ | ■ | ■ | 2 | NE 50/1 COTTON |
| PICK 30 | | ■ | ■ | | ■ | ■ | ■ | | ■ | ■ | ■ | | ■ | 1 | 70 DEN pes lycra |
| PICK 29 | | ■ | ■ | ■ | ■ | ■ | ■ | | ■ | ■ | ■ | ■ | ■ | 2 | NE 50/1 COTTON |
| PICK 28 | | ■ | ■ | ■ | ■ | ■ | ■ | | ■ | ■ | ■ | ■ | ■ | 2 | NE 50/1 COTTON |
| PICK 27 | | ■ | ■ | ■ | | ■ | ■ | ■ | ■ | ■ | | ■ | ■ | 1 | 70 DEN pes lycra |
| PICK 26 | | ■ | ■ | ■ | ■ | ■ | ■ | ■ | ■ | ■ | ■ | ■ | | 2 | NE 50/1 COTTON |
| PICK 25 | | ■ | ■ | ■ | ■ | ■ | ■ | ■ | ■ | ■ | ■ | ■ | | 2 | NE 50/1 COTTON |
| PICK 24 | | | ■ | ■ | ■ | | ■ | ■ | ■ | | ■ | ■ | ■ | 1 | 70 DEN pes lycra |
| PICK 23 | | ■ | ■ | ■ | ■ | | ■ | ■ | ■ | ■ | ■ | ■ | ■ | 2 | NE 50/1 COTTON |
| PICK 22 | | ■ | ■ | ■ | ■ | | ■ | ■ | ■ | ■ | ■ | ■ | ■ | 2 | NE 50/1 COTTON |
| PICK 21 | | ■ | | ■ | ■ | ■ | | ■ | | ■ | ■ | ■ | | 1 | 70 DEN pes lycra |
| PICK 20 | | ■ | ■ | ■ | ■ | ■ | ■ | ■ | ■ | ■ | | ■ | ■ | 2 | NE 50/1 COTTON |
| PICK 19 | | ■ | ■ | ■ | ■ | ■ | ■ | ■ | ■ | ■ | | ■ | ■ | 2 | NE 50/1 COTTON |
| PICK 18 | | ■ | ■ | | ■ | ■ | ■ | | ■ | ■ | ■ | | ■ | 1 | 70 DEN pes lycra |
| PICK 17 | | ■ | ■ | | ■ | ■ | ■ | ■ | ■ | ■ | ■ | ■ | ■ | 2 | NE 50/1 COTTON |
| PICK 16 | | ■ | ■ | | ■ | ■ | ■ | ■ | ■ | ■ | ■ | ■ | ■ | 2 | NE 50/1 COTTON |
| PICK 15 | | ■ | ■ | ■ | | ■ | ■ | ■ | ■ | ■ | | ■ | ■ | 1 | 70 DEN pes lycra |
| PICK 14 | | ■ | ■ | ■ | ■ | ■ | ■ | ■ | | ■ | ■ | ■ | ■ | 2 | NE 50/1 COTTON |
| PICK 13 | | ■ | ■ | ■ | ■ | ■ | ■ | ■ | | ■ | ■ | ■ | ■ | 2 | NE 50/1 COTTON |
| PICK 12 | | | ■ | ■ | ■ | | ■ | ■ | ■ | | ■ | ■ | ■ | 1 | 70 DEN pes lycra |
| PICK 11 | | | ■ | ■ | ■ | ■ | ■ | ■ | ■ | ■ | ■ | ■ | ■ | 2 | NE 50/1 COTTON |
| PICK 10 | | | ■ | ■ | ■ | ■ | ■ | ■ | ■ | ■ | ■ | ■ | ■ | 2 | NE 50/1 COTTON |
| PICK 9 | | ■ | | ■ | ■ | ■ | | ■ | | ■ | ■ | ■ | | 1 | 70 DEN pes lycra |
| PICK 8 | | ■ | ■ | ■ | ■ | ■ | | ■ | ■ | ■ | ■ | ■ | ■ | 2 | NE 50/1 COTTON |
| PICK 7 | | ■ | ■ | ■ | ■ | ■ | | ■ | ■ | ■ | ■ | ■ | ■ | 2 | NE 50/1 COTTON |
| PICK 6 | | ■ | ■ | | ■ | ■ | ■ | | ■ | ■ | ■ | | ■ | 1 | 70 DEN pes lycra |
| PICK 5 | | ■ | ■ | ■ | ■ | ■ | ■ | ■ | ■ | ■ | ■ | | ■ | 2 | NE 50/1 COTTON |
| PICK 4 | | ■ | ■ | ■ | ■ | ■ | ■ | ■ | ■ | ■ | ■ | | ■ | 2 | NE 50/1 COTTON |
| PICK 3 | | ■ | ■ | ■ | | ■ | ■ | ■ | ■ | ■ | | ■ | ■ | 1 | 70 DEN pes lycra |
| PICK 2 | | ■ | ■ | ■ | | ■ | ■ | ■ | ■ | ■ | ■ | ■ | ■ | 2 | NE 50/1 COTTON |
| PICK 1 | | ■ | ■ | ■ | | ■ | ■ | ■ | ■ | ■ | ■ | ■ | ■ | 2 | NE 50/1 COTTON |
| | | W1 | W2 | W3 | W4 | W5 | W6 | W7 | W8 | W9 | W10 | W11 | W12 | | |

FIG. 10

| | | | | | | | | | | | | | | |
|---|---|---|---|---|---|---|---|---|---|---|---|---|---|---|
| PICK 36 | ■ | ■ | ■ | | ■ | ■ | ■ | | ■ | ■ | ■ | | 1 | 70 DEN pes lycra |
| PICK 35 | ■ | ■ | ■ | ■ | ■ | ■ | ■ | ■ | | ■ | ■ | ■ | 2 | NE 50/1 COTTON |
| PICK 34 | ■ | ■ | ■ | ■ | ■ | ■ | ■ | ■ | | ■ | ■ | ■ | 2 | NE 50/1 COTTON |
| PICK 33 | ■ | ■ | | ■ | ■ | ■ | | ■ | ■ | ■ | | ■ | 1 | 70 DEN pes lycra |
| PICK 32 | ■ | | ■ | ■ | ■ | ■ | ■ | ■ | ■ | ■ | ■ | ■ | 2 | NE 50/1 COTTON |
| PICK 31 | ■ | | ■ | ■ | ■ | ■ | ■ | ■ | ■ | ■ | ■ | ■ | 2 | NE 50/1 COTTON |
| PICK 30 | ■ | | ■ | ■ | ■ | | ■ | ■ | ■ | | ■ | ■ | 1 | 70 DEN pes lycra |
| PICK 29 | ■ | ■ | ■ | ■ | ■ | ■ | | ■ | ■ | ■ | ■ | ■ | 2 | NE 50/1 COTTON |
| PICK 28 | ■ | ■ | ■ | ■ | ■ | ■ | | ■ | ■ | ■ | ■ | ■ | 2 | NE 50/1 COTTON |
| PICK 27 | | ■ | ■ | ■ | | ■ | ■ | ■ | | ■ | ■ | ■ | 1 | 70 DEN pes lycra |
| PICK 26 | ■ | ■ | ■ | ■ | ■ | ■ | ■ | ■ | ■ | ■ | ■ | | 2 | NE 50/1 COTTON |
| PICK 25 | ■ | ■ | ■ | ■ | ■ | ■ | ■ | ■ | ■ | ■ | ■ | | 2 | NE 50/1 COTTON |
| PICK 24 | ■ | ■ | ■ | | ■ | ■ | ■ | | ■ | ■ | ■ | | 1 | 70 DEN pes lycra |
| PICK 23 | ■ | ■ | ■ | ■ | | ■ | ■ | ■ | ■ | ■ | ■ | ■ | 2 | NE 50/1 COTTON |
| PICK 22 | ■ | ■ | ■ | ■ | | ■ | ■ | ■ | ■ | ■ | ■ | ■ | 2 | NE 50/1 COTTON |
| PICK 21 | ■ | ■ | | ■ | ■ | ■ | | ■ | ■ | ■ | | ■ | 1 | 70 DEN pes lycra |
| PICK 20 | ■ | ■ | ■ | ■ | ■ | ■ | ■ | ■ | ■ | | ■ | ■ | 2 | NE 50/1 COTTON |
| PICK 19 | ■ | ■ | ■ | ■ | ■ | ■ | ■ | ■ | ■ | | ■ | ■ | 2 | NE 50/1 COTTON |
| PICK 18 | ■ | | ■ | ■ | ■ | | ■ | ■ | ■ | | ■ | ■ | 1 | 70 DEN pes lycra |
| PICK 17 | ■ | ■ | | ■ | ■ | ■ | ■ | ■ | ■ | ■ | ■ | ■ | 2 | NE 50/1 COTTON |
| PICK 16 | ■ | ■ | | ■ | ■ | ■ | ■ | ■ | ■ | ■ | ■ | ■ | 2 | NE 50/1 COTTON |
| PICK 15 | | ■ | ■ | ■ | | ■ | ■ | ■ | | ■ | ■ | ■ | 1 | 70 DEN pes lycra |
| PICK 14 | ■ | ■ | ■ | ■ | ■ | ■ | ■ | | ■ | ■ | ■ | ■ | 2 | NE 50/1 COTTON |
| PICK 13 | ■ | ■ | ■ | ■ | ■ | ■ | ■ | | ■ | ■ | ■ | ■ | 2 | NE 50/1 COTTON |
| PICK 12 | ■ | ■ | ■ | | ■ | ■ | ■ | | ■ | ■ | ■ | | 1 | 70 DEN pes lycra |
| PICK 11 | | ■ | ■ | ■ | ■ | ■ | ■ | ■ | ■ | ■ | ■ | ■ | 2 | NE 50/1 COTTON |
| PICK 10 | | ■ | ■ | ■ | ■ | ■ | ■ | ■ | ■ | ■ | ■ | ■ | 2 | NE 50/1 COTTON |
| PICK 9 | ■ | ■ | | ■ | ■ | ■ | | ■ | ■ | ■ | | ■ | 1 | 70 DEN pes lycra |
| PICK 8 | ■ | ■ | ■ | ■ | ■ | | ■ | ■ | ■ | ■ | ■ | ■ | 2 | NE 50/1 COTTON |
| PICK 7 | ■ | ■ | ■ | ■ | ■ | | ■ | ■ | ■ | ■ | ■ | ■ | 2 | NE 50/1 COTTON |
| PICK 6 | ■ | | ■ | ■ | ■ | | ■ | ■ | ■ | | ■ | ■ | 1 | 70 DEN pes lycra |
| PICK 5 | ■ | ■ | ■ | ■ | ■ | ■ | ■ | ■ | ■ | ■ | | ■ | 2 | NE 50/1 COTTON |
| PICK 4 | ■ | ■ | ■ | ■ | ■ | ■ | ■ | ■ | ■ | ■ | | ■ | 2 | NE 50/1 COTTON |
| PICK 3 | | ■ | ■ | ■ | | ■ | ■ | ■ | | ■ | ■ | ■ | 1 | 70 DEN pes lycra |
| PICK 2 | ■ | ■ | ■ | | ■ | ■ | ■ | ■ | ■ | ■ | ■ | ■ | 2 | NE 50/1 COTTON |
| PICK 1 | ■ | ■ | ■ | | ■ | ■ | ■ | ■ | ■ | ■ | ■ | ■ | 2 | NE 50/1 COTTON |
| | W1 | W2 | W3 | W4 | W5 | W6 | W7 | W8 | W9 | W10 | W11 | W12 | | |

FIG. 13

| | | | | | | | | | | | | | | |
|---|---|---|---|---|---|---|---|---|---|---|---|---|---|---|
| PICK 36 | ■ | ■ | | ■ | ■ | | ■ | ■ | | ■ | ■ | | 1 | 70 DEN pes lycra |
| PICK 35 | ■ | ■ | ■ | ■ | ■ | ■ | ■ | ■ | | ■ | ■ | ■ | 2 | 150 DEN micro pes |
| PICK 34 | ■ | ■ | ■ | ■ | ■ | ■ | ■ | ■ | | ■ | ■ | ■ | 3 | 150 DEN micro pes |
| PICK 33 | ■ | | ■ | ■ | | ■ | ■ | | ■ | ■ | | ■ | 1 | 70 DEN pes lycra |
| PICK 32 | ■ | | ■ | ■ | ■ | ■ | ■ | ■ | ■ | ■ | ■ | ■ | 2 | 150 DEN micro pes |
| PICK 31 | ■ | | ■ | ■ | ■ | ■ | ■ | ■ | ■ | ■ | ■ | ■ | 3 | 150 DEN micro pes |
| PICK 30 | | ■ | ■ | | ■ | ■ | | ■ | ■ | | ■ | ■ | 1 | 70 DEN pes lycra |
| PICK 29 | ■ | ■ | ■ | ■ | ■ | ■ | | ■ | ■ | ■ | ■ | ■ | 2 | 150 DEN micro pes |
| PICK 28 | ■ | ■ | ■ | ■ | ■ | ■ | | ■ | ■ | ■ | ■ | ■ | 3 | 150 DEN micro pes |
| PICK 27 | ■ | ■ | | ■ | ■ | | ■ | ■ | | ■ | ■ | | 1 | 70 DEN pes lycra |
| PICK 26 | ■ | ■ | ■ | ■ | ■ | ■ | ■ | ■ | ■ | ■ | ■ | | 2 | 150 DEN micro pes |
| PICK 25 | ■ | ■ | ■ | ■ | ■ | ■ | ■ | ■ | ■ | ■ | ■ | | 3 | 150 DEN micro pes |
| PICK 24 | ■ | | ■ | ■ | | ■ | ■ | | ■ | ■ | | ■ | 1 | 70 DEN pes lycra |
| PICK 23 | ■ | ■ | ■ | ■ | | ■ | ■ | ■ | ■ | ■ | ■ | ■ | 2 | 150 DEN micro pes |
| PICK 22 | ■ | ■ | ■ | ■ | | ■ | ■ | ■ | ■ | ■ | ■ | ■ | 3 | 150 DEN micro pes |
| PICK 21 | | ■ | ■ | | ■ | ■ | | ■ | ■ | | ■ | ■ | 1 | 70 DEN pes lycra |
| PICK 20 | ■ | ■ | ■ | ■ | ■ | ■ | ■ | ■ | ■ | | ■ | ■ | 2 | 150 DEN micro pes |
| PICK 19 | ■ | ■ | ■ | ■ | ■ | ■ | ■ | ■ | ■ | | ■ | ■ | 3 | 150 DEN micro pes |
| PICK 18 | ■ | ■ | | ■ | ■ | | ■ | ■ | | ■ | ■ | | 1 | 70 DEN pes lycra |
| PICK 17 | ■ | ■ | | ■ | ■ | ■ | ■ | ■ | ■ | ■ | ■ | ■ | 2 | 150 DEN micro pes |
| PICK 16 | ■ | ■ | | ■ | ■ | ■ | ■ | ■ | ■ | ■ | ■ | ■ | 3 | 150 DEN micro pes |
| PICK 15 | ■ | | ■ | ■ | | ■ | ■ | | ■ | ■ | | ■ | 1 | 70 DEN pes lycra |
| PICK 14 | ■ | ■ | ■ | ■ | ■ | ■ | ■ | | ■ | ■ | ■ | ■ | 2 | 150 DEN micro pes |
| PICK 13 | ■ | ■ | ■ | ■ | ■ | ■ | ■ | | ■ | ■ | ■ | ■ | 3 | 150 DEN micro pes |
| PICK 12 | | ■ | ■ | | ■ | ■ | | ■ | ■ | | ■ | ■ | 1 | 70 DEN pes lycra |
| PICK 11 | | ■ | ■ | ■ | ■ | ■ | ■ | ■ | ■ | ■ | ■ | ■ | 2 | 150 DEN micro pes |
| PICK 10 | | ■ | ■ | ■ | ■ | ■ | ■ | ■ | ■ | ■ | ■ | ■ | 3 | 150 DEN micro pes |
| PICK 9 | ■ | ■ | | ■ | ■ | | ■ | ■ | | ■ | ■ | | 1 | 70 DEN pes lycra |
| PICK 8 | ■ | ■ | ■ | ■ | ■ | | ■ | ■ | ■ | ■ | ■ | ■ | 2 | 150 DEN micro pes |
| PICK 7 | ■ | ■ | ■ | ■ | ■ | | ■ | ■ | ■ | ■ | ■ | ■ | 3 | 150 DEN micro pes |
| PICK 6 | ■ | | ■ | ■ | | ■ | ■ | | ■ | ■ | | ■ | 1 | 70 DEN pes lycra |
| PICK 5 | ■ | ■ | ■ | ■ | ■ | ■ | ■ | ■ | ■ | ■ | | ■ | 2 | 150 DEN micro pes |
| PICK 4 | ■ | ■ | ■ | ■ | ■ | ■ | ■ | ■ | ■ | ■ | | ■ | 3 | 150 DEN micro pes |
| PICK 3 | | ■ | ■ | | ■ | ■ | | ■ | ■ | | ■ | ■ | 1 | 70 DEN pes lycra |
| PICK 2 | ■ | ■ | ■ | | ■ | ■ | ■ | ■ | ■ | ■ | ■ | ■ | 2 | 150 DEN micro pes |
| PICK 1 | ■ | ■ | ■ | | ■ | ■ | ■ | ■ | ■ | ■ | ■ | ■ | 3 | 150 DEN micro pes |
| | W1 | W2 | W3 | W4 | W5 | W6 | W7 | W8 | W9 | W10 | W11 | W12 | | |

FIG. 14

| | | | | | | | | | | | | | | |
|---|---|---|---|---|---|---|---|---|---|---|---|---|---|---|
| PICK 36 | ■ | ■ | | ■ | ■ | | ■ | ■ | | ■ | ■ | | 1 | 70 DEN pes lycra |
| PICK 35 | ■ | ■ | ■ | ■ | ■ | ■ | ■ | ■ | | ■ | ■ | ■ | 2 | NE 16/1 COTTON |
| PICK 34 | ■ | ■ | ■ | ■ | ■ | ■ | ■ | ■ | | ■ | ■ | ■ | 3 | NE 16/1 COTTON |
| PICK 33 | ■ | | ■ | ■ | | ■ | ■ | | ■ | ■ | | ■ | 1 | 70 DEN pes lycra |
| PICK 32 | ■ | | ■ | ■ | ■ | ■ | ■ | ■ | ■ | ■ | ■ | ■ | 2 | NE 16/1 COTTON |
| PICK 31 | ■ | | ■ | ■ | ■ | ■ | ■ | ■ | ■ | ■ | ■ | ■ | 3 | NE 16/1 COTTON |
| PICK 30 | | ■ | ■ | | ■ | ■ | | ■ | ■ | | ■ | ■ | 1 | 70 DEN pes lycra |
| PICK 29 | ■ | ■ | ■ | ■ | ■ | ■ | | ■ | ■ | ■ | ■ | ■ | 2 | NE 16/1 COTTON |
| PICK 28 | ■ | ■ | ■ | ■ | ■ | ■ | | ■ | ■ | ■ | ■ | ■ | 3 | NE 16/1 COTTON |
| PICK 27 | ■ | ■ | | ■ | ■ | | ■ | ■ | | ■ | ■ | | 1 | 70 DEN pes lycra |
| PICK 26 | ■ | ■ | ■ | ■ | ■ | ■ | ■ | ■ | ■ | ■ | ■ | | 2 | NE 16/1 COTTON |
| PICK 25 | ■ | ■ | ■ | ■ | ■ | ■ | ■ | ■ | ■ | ■ | ■ | | 3 | NE 16/1 COTTON |
| PICK 24 | ■ | | ■ | ■ | | ■ | ■ | | ■ | ■ | | ■ | 1 | 70 DEN pes lycra |
| PICK 23 | ■ | ■ | ■ | ■ | | ■ | ■ | ■ | ■ | ■ | ■ | ■ | 2 | NE 16/1 COTTON |
| PICK 22 | ■ | ■ | ■ | ■ | | ■ | ■ | ■ | ■ | ■ | ■ | ■ | 3 | NE 16/1 COTTON |
| PICK 21 | | ■ | ■ | | ■ | ■ | | ■ | ■ | | ■ | ■ | 1 | 70 DEN pes lycra |
| PICK 20 | ■ | ■ | ■ | ■ | ■ | ■ | ■ | ■ | ■ | | ■ | ■ | 2 | NE 16/1 COTTON |
| PICK 19 | ■ | ■ | ■ | ■ | ■ | ■ | ■ | ■ | ■ | | ■ | ■ | 3 | NE 16/1 COTTON |
| PICK 18 | ■ | ■ | | ■ | ■ | | ■ | ■ | | ■ | ■ | | 1 | 70 DEN pes lycra |
| PICK 17 | ■ | ■ | | ■ | ■ | ■ | ■ | ■ | ■ | ■ | ■ | ■ | 2 | NE 16/1 COTTON |
| PICK 16 | ■ | ■ | | ■ | ■ | ■ | ■ | ■ | ■ | ■ | ■ | ■ | 3 | NE 16/1 COTTON |
| PICK 15 | ■ | | ■ | ■ | | ■ | ■ | | ■ | ■ | | ■ | 1 | 70 DEN pes lycra |
| PICK 14 | ■ | ■ | ■ | ■ | ■ | ■ | ■ | | ■ | ■ | ■ | ■ | 2 | NE 16/1 COTTON |
| PICK 13 | ■ | ■ | ■ | ■ | ■ | ■ | ■ | | ■ | ■ | ■ | ■ | 3 | NE 16/1 COTTON |
| PICK 12 | | ■ | ■ | | ■ | ■ | | ■ | ■ | | ■ | ■ | 1 | 70 DEN pes lycra |
| PICK 11 | | ■ | ■ | ■ | ■ | ■ | ■ | ■ | ■ | ■ | ■ | ■ | 2 | NE 16/1 COTTON |
| PICK 10 | | ■ | ■ | ■ | ■ | ■ | ■ | ■ | ■ | ■ | ■ | ■ | 3 | NE 16/1 COTTON |
| PICK 9 | ■ | ■ | | ■ | ■ | | ■ | ■ | | ■ | ■ | | 1 | 70 DEN pes lycra |
| PICK 8 | ■ | ■ | ■ | ■ | ■ | | ■ | ■ | ■ | ■ | ■ | ■ | 2 | NE 16/1 COTTON |
| PICK 7 | ■ | ■ | ■ | ■ | ■ | | ■ | ■ | ■ | ■ | ■ | ■ | 3 | NE 16/1 COTTON |
| PICK 6 | ■ | | ■ | ■ | | ■ | ■ | | ■ | ■ | | ■ | 1 | 70 DEN pes lycra |
| PICK 5 | ■ | ■ | ■ | ■ | ■ | ■ | ■ | ■ | ■ | ■ | | ■ | 2 | NE 50/1 COTTON |
| PICK 4 | ■ | ■ | ■ | ■ | ■ | ■ | ■ | ■ | ■ | ■ | | ■ | 3 | NE 50/1 COTTON |
| PICK 3 | | ■ | ■ | | ■ | ■ | | ■ | ■ | | ■ | ■ | 1 | 70 DEN pes lycra |
| PICK 2 | ■ | ■ | ■ | | ■ | ■ | ■ | ■ | ■ | ■ | ■ | ■ | 2 | NE 16/1 COTTON |
| PICK 1 | ■ | ■ | ■ | | ■ | ■ | ■ | ■ | ■ | ■ | ■ | ■ | 3 | NE 16/1 COTTON |
| | W1 | W2 | W3 | W4 | W5 | W6 | W7 | W8 | W9 | W10 | W11 | W12 | | |

WOVEN FABRIC THAT LOOKS AND PERFORMS LIKE A KNITTED FABRIC AND METHOD OF MAKING THEREOF

CROSS REFERENCE TO RELATED APPLICATIONS

This application is a National Stage of International Application No. PCT/EP2011/000902 filed Feb. 24, 2011, which is a Continuation-in-part of Ser. No. 12/778,547 filed May 12, 2010 (pending) and claims priority based on U.S. Provisional Application No. 61/308,824, filed Feb. 26, 2010, the contents of all of which are incorporated herein by reference in their entirety.

FIELD OF THE INVENTION

Articles and methods consistent with the present invention relate to woven textiles.

DESCRIPTION OF RELATED ART

Woven fabrics and knitted fabrics, as a general rule, have very different qualities. Woven fabrics such as denim gabardine, poplin, and others tend to be stable, but more rigid than knitted fabrics, and therefore do not drape well over a figure. Knitted fabrics are flexible, stretch in both the vertical and horizontal direction even if inelastic yarns are used, and drape well over the body.

Denim, an indigo dyed woven fabric, has enjoyed popularity in the fashion industry at least partly due to the ring dyeing process used in creating the indigo yarns. In general, indigo dye is located close to the surface of the yarns, leaving the core of the yarn undyed. Because the dye is located at the surface of the yarns, denim fabrics fade differently than fabrics made from non-ring dyed yarns. Additionally, different finishing techniques can be applied to denim to take advantage of these ring dyed yarns. For example, denim can be hand scraped, sand blasted, stone washed, or treated in other ways that allow varying amounts of the undyed cores of the indigo yarns to become visible. The effects created through these treatments have made denim a popular and fashionable fabric in the clothing and textile industries.

Due to denim's woven nature, it has rarely been used for tops, such as shirts, blouses and sweatshirts. On the other hand, knit indigo fabrics have failed to become popular due the expense necessary to create them. For example, to create a knit fabric, the yarns used must be wound on a bobbin. This is an expensive, additional step needed to create knitted indigo fabrics. Some have attempted to dye fabrics with indigo after knitting has taken place, but this too comes with problems. Dyeing after knitting is difficult to control due to the elastic nature of the fabric. Furthermore, both sides of the fabric end up dyed with indigo which can lead to staining if the person wearing the fabric sweats. Still others have tried dying the knitting yarns with indigo while on the bobbin, but this too gives unsatisfactory results.

SUMMARY

It is an aim of the present invention to solve the above problems and to provide a woven fabric that has the look and the feel and the performance of a knitted fabric. Preferably the woven fabric is a denim-like fabric.

The above aim is solved by the present invention. An exemplary embodiment of the invention is to provide an article that looks, feels, and performs like a knitted fabric, but is created through weaving. Another exemplary embodiment of the invention is to provide a method for making such an article.

In accordance with an exemplary embodiment of the present invention, there is provided an article comprising a fabric having a front side and a back side and including a plurality of warp yarns and a plurality of weft yarns woven together in a pattern, wherein the weft yarns include hard yarns and elastomeric yarns arranged in a predetermined arrangement comprising at least one hard yarn alternately arranged with at least one elastomeric yarn, the elastomeric yarns having a greater shrinkage ratio than the shrinkage ratio of the hard yarns, wherein the hard yarns form alternately arranged under portions and over portions with respect to said warp yarns, said under portions being formed when said hard yarns pass along the back side of the warp yarns and defining loop portions, and said over portions being formed when the hard yarns pass along the front side of the warp yarns and define connection portions, wherein for each hard yarn, an average number of warp yarns passed by the loop portion is at least 6, and wherein the elastomeric yarns form alternately arranged under portions and over portions with respect to said warp yarns in a weave that is tighter than the weave of the hard yarns.

It should be noted that while this disclosure uses the terms "elastomeric" and "hard" to describe yarns, for the purposes of this disclosure "elastomeric" simply means that the yarns have a greater shrinkage ratio than the "hard" yarns. It could very well be the case that both the "elastomeric" and "hard" weft yarns are elastic, or neither of the "elastomeric" or "hard" weft yarns are elastic.

In other words, the invention relates to a woven fabric that has a warp yarns and weft yarns, the weft yarns extending over selected warp yarns to provide over portions and extending on the back side of the fabric between two adjacent over portions to define under portions of the weft yarns, characterized in that the weft yarns comprise a plurality of first weft yarns that have a first shrinkage ratio and a plurality of second weft yarns that have a second shrinkage ratio, wherein the second weft yarns have a shrinkage ratio greater than the shrinkage ratio of the first weft yarns, the first and second weft yarns being alternated to provide a fabric pattern, and further characterized in that the under portions of said plurality of first weft yarns extend to cover at least 6 warp yarns and in that the under portions of said second weft yarns extend for an amount of warp yarns that is less than 6.

Preferably, the shrinkage ratio of the elastomeric yarns is at least 10% greater than the shrinkage ratio of the hard yarns, when measured in the same way, i.e. with the same test, and the number of warp yarns defining an under portion of the first weft yarns (i.e. the number of warp yarns between two adjacent over portions of a first weft yarns) is within the range of 6 to 24. Suitable apparatuses for measuring the shrinkage ratio are known in the art, e.g. an Uster Tensorapid tester (Uster, CH) can be used to determine the shrinkage ratio.

For the purposes of the present disclosure, the wording "in a weave that is tighter than the weave of the hard yarns" means that one of the weft yarns, namely the elastomeric yarn, makes more up and downs between the warp yarns than the hard weft yarn does. An up and down means that the weft comes up to the front side of the fabric and after passing over the warp yarn (defining an over portion) goes down to the back side of the fabric; the front side of the fabric is the visible side and the back side is the side that will rest on the user of the article or garment obtained from or including the fabric. In other words, in a unitary length of weft yarn, as defined by the number of warp yarns between one over portion (included) and the adjacent over portion (excluded), the number of warp yarns defined by the under portion of an elastomeric yarn (or second yarn) is always less than that defined by the under portion of a hard (or first) yarn. Preferably, for the same unitary length of fabric, as defined by a weave report (see hereinafter FIGS. 5-14) the number of up and down movement of the second, elastomeric, weft yarn is 2 to 12 times the number of up and down movements of the hard yarn; this results in a ratio of over portions of elastomeric yarn/hard yarn that is within the range 2 to 12, preferably 3 to 6. In other words, in a same width of fabric, the amount of over portions of the elastomeric (second) yarn is 2 to 12 times greater than the amount of over portions of the first (hard) yarn, the elastomeric yarn being tighter woven then the hard yarn. Preferably, the average ratio of elastomeric yarns to hard yarns is between 2:1 and 1:5, inclusive. It is more preferred that the average ratio of elastomeric yarns to hard yarns is between 1:2 and 1:3, inclusive. Furthermore, the ratio of elastomeric yarns to hard yarns need not be regular, or the same throughout the fabric.

In a preferred embodiment, the number of warp yarns defining an under portion of the second, elastomeric, weft yarns is 5 or less, the number of warp yarns passed by the loop portion of the hard yarn is within the range of 6 to 24, the shrinkage ratio of the elastomeric yarns is at least 10% greater than the shrinkage ratio of the hard yarns, the ratio of over portions (or up and down movements) of one elastomeric yarn to one hard yarn is in the range of 2:1 to 12:1, preferably 3:1 to 6:1, and the ratio of elastomeric yarns to hard yarns is between 2:1 and 1:5, inclusive. A most preferred embodiment has a ratio of elastomeric yarns to hard yarns of 1:2; a ratio of over portions in the elastomeric yarn to over portions in one hard yarn of 4:1; a back portion or loop portion of the hard yarn of 11 warps per 1 warp of over portion (11-1) and a back portion of the elastomeric yarn that is of 2 warps per one warp of elastomeric yarn (2-1) as exemplified in FIG. 5.

In accordance with an exemplary embodiment of the present invention, after the weaving, but before a shrinking, the predetermined arrangement comprises a warp density between approximately 20 and 70 warps/cm, inclusive.

According to another exemplary embodiment of the present invention after three home washes (carried out according to BS 63302A or ASTM D 3776/96) the predetermined arrangement comprises a warp density between approximately 25 and 80 warps/cm and a weft density between approximately 25 and 80 weft/cm, inclusive.

In yet another exemplary embodiment of the present invention, after the weaving, but before a shrinking the predetermined arrangement comprises a weft density between 20 and 70 weft/cm, inclusive.

In a further exemplary embodiment of the present invention, the warp yarns have an English cotton number between approximately Ne 10 and Ne 40, inclusive.

Similarly, in another exemplary embodiment of the present invention, the elastomeric yarns have a denier between approximately 40 and 140 denier, inclusive. In still another exemplary embodiment of the present invention, the hard yarns have an English cotton number between approximately Ne 10 and Ne 60, inclusive.

In still yet another exemplary embodiment of the present invention, the warp yarns are ring-dyed indigo yarns.

In accordance with another exemplary embodiment of the invention, what is provided is an article comprising a fabric having a first weave and a second weave; wherein the first weave forms a front face of the fabric, the first weave substantially comprising warp yarns and elastomeric weft yarns tightly woven in a predetermined pattern, wherein the second weave forms a back face of the fabric, the second weave substantially comprising said warp yarns and hard weft yarns loosely woven in a predetermined pattern such that said hard weft yarns form alternately arranged under portions and over portions with respect to said warp yarns, said under portions being formed when said hard weft yarns pass along the back side of the warp yarns and defining loop portions and said over portions being formed when said hard weft yarn passes along the front side of the warp yarns and defining connection portions, wherein for each hard weft yarn, an average number of warp yarns passed by the loop portion is at least 6, wherein the elastomeric weft yarns form alternately arranged under portions and over portions with respect to said warp yarns in a weave that is tighter than the weave of the hard yarns, and wherein said elastomeric and hard weft yarns are arranged in a predetermined arrangement comprising at least one hard yarn alternately arranged with at least one elastomeric yarn, the elastomeric yarns having a greater shrinkage ratio than the shrinkage ratio of the hard yarns.

According to another exemplary embodiment of the invention, a method is provided for creating a fabric, the method comprising providing warp yarns; providing hard weft yarns; providing elastomeric weft yarns, the elastomeric weft yarns having a greater shrinkage ratio than the shrinkage ratio of the hard weft yarns, the shrinkage ratio being that the elastomeric yarns are capable of greater shrinkage than the hard yarns; selecting a weave pattern wherein at least one hard yarn is alternately arranged with at least one elastomeric yarn, the hard yarns pass alternately along the back side of the warp yarns a predetermined number of warp yarns for each pass to form a series of hard under portions, and along the front side of the warp yarns a predetermined number of warp yarns for each pass to form hard over portions, and for each hard yarn, an average number of warp yarns passed by each under portion is at least 6, and the elastomeric yarns pass alternately along the back side of the warp yarns a predetermined number of warp yarns for each pass to form a series of elastomeric under portions, and along the front side of the warp yarns a predetermined number of warp yarns for each pass to form a series of elastomeric over portions; weaving the fabric according to the selected pattern; shrinking the woven fabric wherein the elastomeric weft yarns shrink more than the hard weft yarns causing the hard under portions to form loop portions.

The invention provides several advantages with respect to the prior art. The result of the inclusion of alternate elastomeric and hard weft yarns is that an elastic "structure" is created within the fabric; when the completed fabric is removed from the loom, i.e. is no longer under tension, the first and second yarns shrink in a different way and to a different degree, namely the elastomeric yarns shrink more than the hard yarns and the hard yarns under portions provide a plurality of loops on the back of the fabric (i.e. on the side of the fabric that will face the body of the user). This gives the fabric the hand, the feeling and the look of a knitted fabric even if it is made on looms for woven fabric. Costs for knitting apparatuses are therefore saved. Moreover, indigo dyed warp yarns, especially indigo ring-dyed yarns can be used without problems because the loops will protect the body of the user from possible staining of the indigo. When using indigo dyed warp yarns th resulting fabric has the look and the feeling (hand) of a knitted denim, which effect was not achievable with the prior art techniques.

BRIEF DESCRIPTION OF THE DRAWINGS

The above and/or other aspects will become apparent and more readily appreciated from the following description of the exemplary embodiments, taken in conjunction with the accompanying drawings, in which are depicted:

FIG. 6—A weave report for an exemplary embodiment as described in Example 2 below.

FIG. 8—A weave report for an exemplary embodiment as described in Example 4 below.

FIG. 10—A weave report for an exemplary embodiment as described in Example 6 below.

FIG. 13—A weave report for an exemplary embodiment as described in Example 9 below.

FIG. 14—A weave report for an exemplary embodiment as described in Example 10 below.

DETAILED DESCRIPTION OF EXEMPLARY EMBODIMENTS

Figure 1:
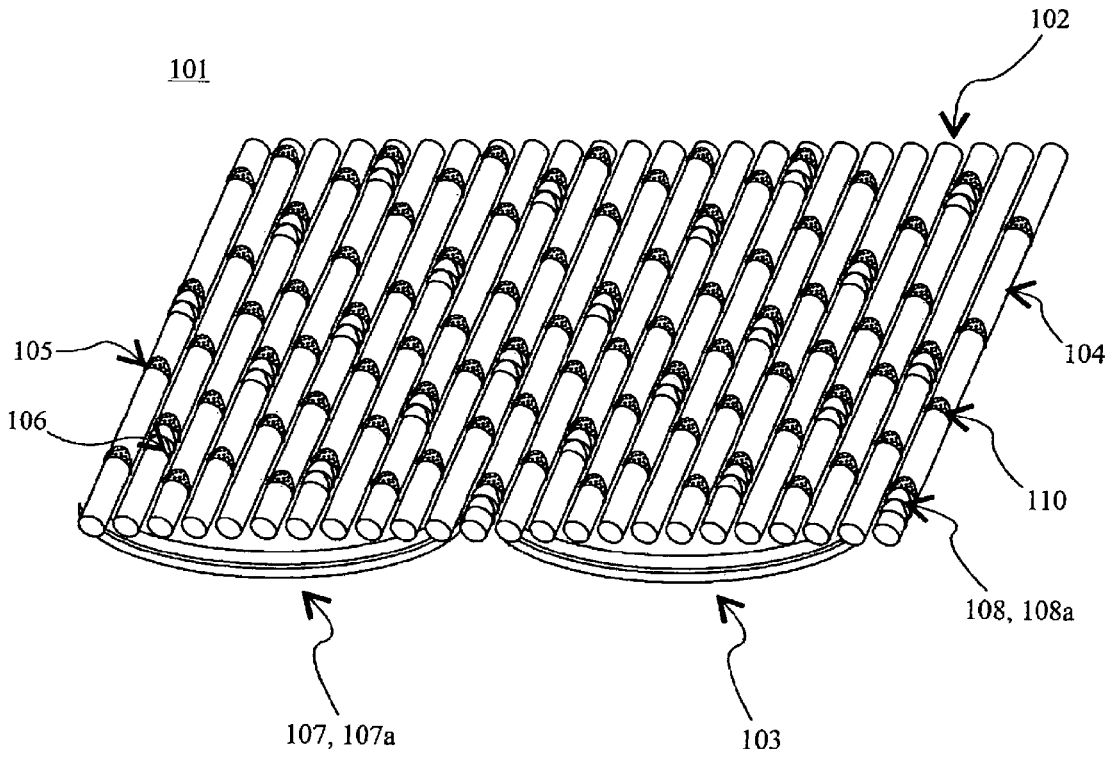
FIG. 1—A fabric according to an exemplary embodiment.

Below, exemplary embodiments will be described in detail with reference to accompanying drawings so as to be readily understood by a person of ordinary skill in the art. The inventive concept may be embodied in various forms without being limited to the exemplary embodiments set forth herein. Descriptions of well-known parts are omitted for clarity, and like reference numerals refer to like elements throughout.

An article according to a first exemplary embodiment is shown in FIG. 1. Illustrated is a woven fabric 101 having a front side 102 and a backside 103. The fabric 101 is woven together from warp yarns 104 and weft yarns 105, 106. According to the preferred embodiment, the warp yarns are indigo dyed.

According to the exemplary embodiment, the weft yarns comprise elastomeric yarns 105 and hard yarns 106. In this exemplary embodiment the elastomeric (or second) yarns 105 have a greater shrinkage ratio than the hard (or first) yarns 106. The elastomeric yarns 105 and hard yarns 106 are arranged in a predetermined arrangement comprising at least one hard yarn 106 alternately arranged with at least one elastomeric yarn 105. According to the exemplary embodiment illustrated in FIG. 1, there is a single elastomeric yarn 105 arranged between two hard yarns 106, but the yarns could be arranged differently without deviating from the inventive concept. For example, in preferred embodiments, the ratio of elastomeric yarns 105 to hard yarns 106 is between 2:1 and 1:5, inclusive. It is more preferred that the average ratio of elastomeric yarns 105 to hard yarns 106 is between 1:2 and 1:3, inclusive. Furthermore, the ratio of elastomeric yarns 105 to hard yarns 106 need not be regular, or the same throughout the fabric.

The weave of the fabric is such that the hard yarns form alternately arranged under portions 107 and over portions 108 with respect to the warp yarns 104. The under portions 107 are formed when the hard yarns pass along the backside of the warp yarns and defining loop portions 107*a*. The over portions are formed when the hard yarns pass along the front side of the warp yarns 104 and define connections portions 108*a*.

In the exemplary embodiment, the fabric comprises hard weft yarns 106, for which the number of warp yarns 104 passed by each loop portion 107*a* is at least 6 and preferably within the range of 6 to 24; the number of warp yarns 104 passed by each loop portions 107*a* need not be the same for all loop portions 107*a*. It is not strictly necessary that every single loop portion 107*a* pass at least 6 warp yarns 104. So long as for each hard yarn 106 the average number of warp yarns 104 passed by each loop is at least 6, the number of warp yarns 104 passed by individual loop portions 107*a* can vary without deviating from the inventive concept, as would be known to one skilled in the art, provided the required loops are obtained on the back side of the fabric.

While FIG. 1 illustrates the loop portions 107*a* passing eleven warp yarns 104 compared to the one warp yarn 104 passed by each connection portion 108*a*, in other exemplary embodiments the ratio of warp yarns 104 passed by loop portions 107*a* to warp yarns 104 passed by connection portions 108*a* is between approximately 6:1 and 24:1, inclusive.

Figure 2:
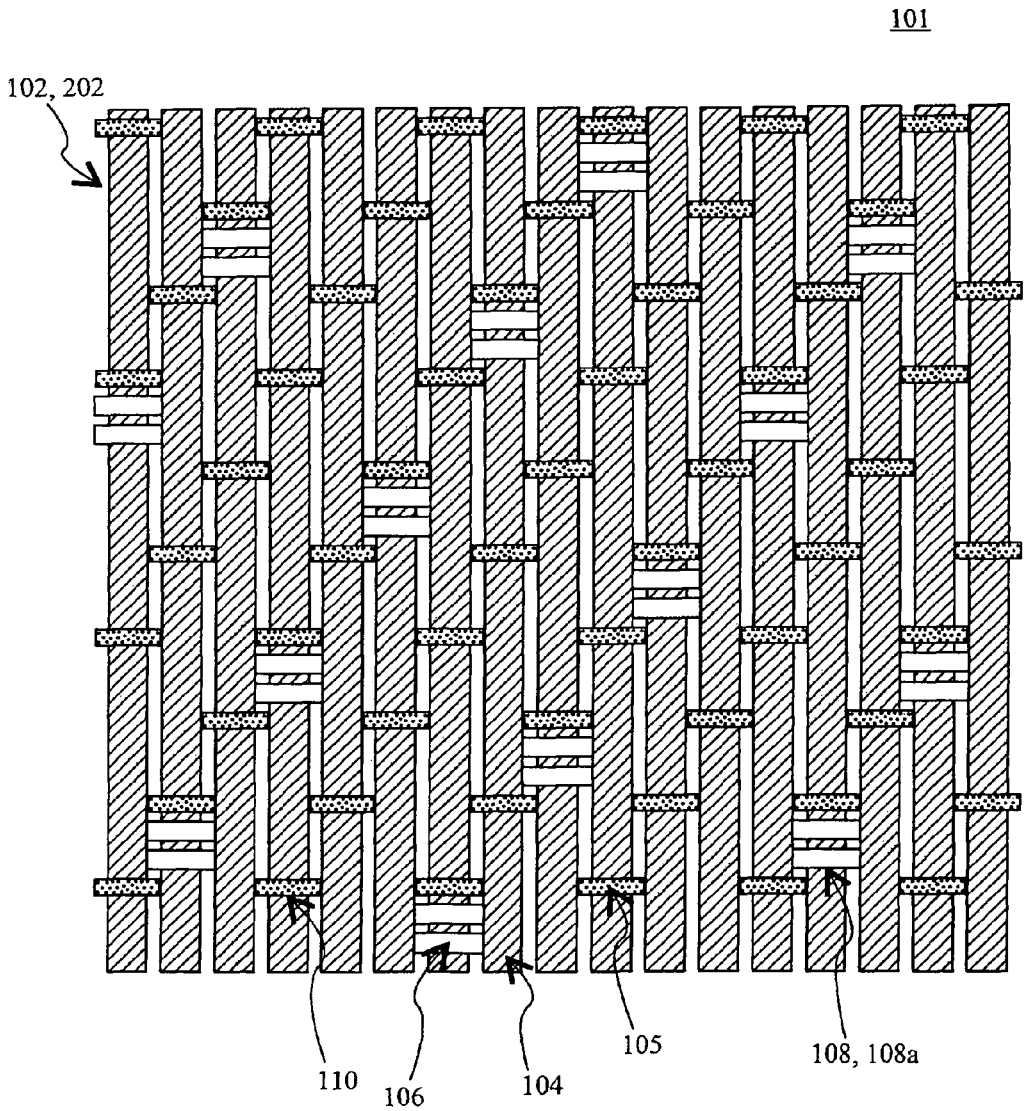
FIG. 2—A front face of a fabric according to an exemplary embodiment.
Figure 3:
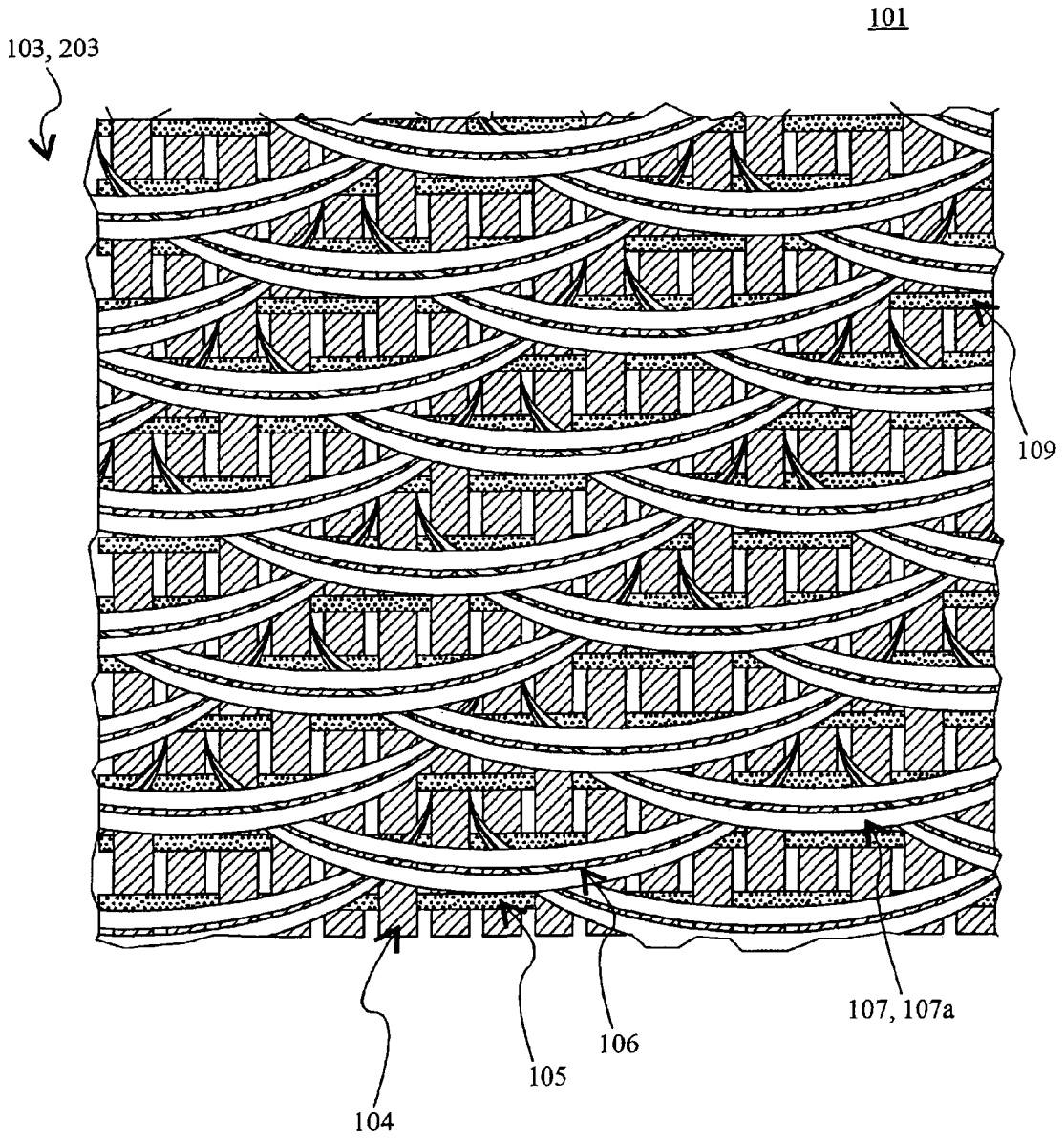
FIG. 3—A back face of a fabric according to an exemplary embodiment.

The elastomeric yarns form alternately arranged under portions 109 and over portions 110 with respect to said warp yarns 104 in the weave. These under portions 109 and over portions 110 form a weave with respect to the warp yarns 104 that is tighter than the weave formed by the hard yarns 106. While the weave pattern illustrated in FIGS. 1-3 shows over portions 110 passing one warp yarn 104 and under portion 109 passing two warp yarns 104, the number of warp yarns 104 passed by the over portions 110 and under portions 109 can vary without deviating from the inventive concept.

According to exemplary embodiments, the loop portions 107*a* of the hard yarns are created such that they are in substantially less tension than under portions 109 and over portions 110 created by the elastomeric weft yarns 105. It can also be the case that the loop portions 107*a* are in at least one of equilibrium or compression.

The loop portions 107*a* help to add to the knit-like appearance and behavior of the woven fabric. For example, loose loops 107*a* can hang loosely at the back of the fabric such that they are droopy. The droopy nature of the loop portions 107*a* gives the fabric a softer feel, much like that of a knitted fabric.

Also, because knitted fabrics are created by connecting yarn loops together, the loop portions 107*a* give the back of the fabric the appearance of a knitted fabric. In addition, because of their length and droopiness, the loop portions 107*a* are able to cover a substantially larger portion of the back of the fabric than if they were tightly woven against the warp yarns. This allows the loop portions 107*a* to substantially hide the sometimes uncomfortable under portions 109. When the loop portions 107*a* are made from soft cotton yarns, as would often be the case, they provide a soft, comfortable backside to the fabric.

An additional benefit of the droopy loop portions 107*a* is helping to prevent the warp yarns 104 from contacting the skin. This benefit is of particular importance to denim fabrics made from indigo dyed yarns. If these warps yarns 106 are indigo dyed and are allowed to come in contact with the wearer's skin, they can stain the skin when the wearer sweats.

As seen in FIGS. 1 and 3, the loop portions 107*a* form a pattern extending in a diagonal direction with respect to the warp yarns 104 and weft yarns 105, 106. Similarly, the connection portions 108*a* form a pattern extending in a diagonal direction with respect to the warp yarns 104 and weft yarns 105, 106. As seen in FIG. 1, the weave pattern of the hard yarns can be different than the weave pattern of the elastomeric yarns. For example, the weave pattern chosen for the hard yarns could be a twill pattern, with some other type of pattern chosen for the elastomeric yarns. In exemplary embodiments, the weave pattern and/or yarn selection allows the fabric 101 to stretch in a diagonal direction with respect to the warp yarns 104 and weft yarns 105, 106.

By using diagonal patterns, multiple benefits can be achieved. First, when the warp yarns 104 are indigo dyed, the use of a diagonal pattern can give the fabric the look of a classic denim weave, while maintaining all the benefits of the feel and behavior of a knitted fabric. The diagonal patterns also allow the fabric to stretch in the diagonal direction, further adding to the knit-like behavior of the fabric.

In exemplary embodiments, the preferred warp density after weaving but before shrinking is between approximately 20 and 70 warp yarns per centimeter, inclusive. After treatment of the fabric and after three home washes, the preferred warp density is between approximately 25 and 80 warp yarns per centimeter, inclusive. Home washes are carried out at 60° C. followed by drying and the last wash and dry is followed by a conditioning a step for 8 hours; these tests are usual in the art and reference to ASTM D 3776/96 and to BS 63302A is made. It is even more preferred that the warp density after weaving but before shrinking be between approximately 25 and 60 warp yarns per centimeter, inclusive, and between approximately 30 and 65 warp yarns per centimeter after three home washes. Even more preferably, the warp density would be between approximately 30 and 50 warp yarns per centimeter, inclusive, after weaving but before shrinking, and between approximately 35 and 55 warp yarns per centimeter after three home washes. Generally, the warp and weft density measurements are made at 65% humidity, ±5%, and 20° C., ±2° C. Similar to the warp density, exemplary embodiments can also define weft densities. It is preferred that after weaving, but before shrinking, the weft density be between approximately 30 and 90 weft yarns per centimeter, inclusive. After three home washes it is preferred that the weft density be between approximately 35 and 95 wefts per centimeter, inclusive. In preferred embodiments, it is more preferred that after weaving, but before shrinking, the weft density be between approximately 40 and 80 wefts per centimeter, inclusive. After three home washings, it is more preferred that the weft density be between approximately 45 and 85 wefts per centimeter, inclusive. It is even more preferred that after weaving but before shrinking, the weft density be between 50 and 70 wefts per centimeter, inclusive, and between approximately 55 and 75 wefts per centimeter, inclusive, after three home washes.

The selection of the warp and weft densities not only adds to the knit-like behavior of the fabric, but it also allows, in conjunction with the selection of appropriate yarns, for the creation of fabrics having different weights. For example, the weight can be chosen to be similar to that of a t-shirt, or alternatively, similar to that of sweatpants. In exemplary embodiments, the ratio of the average number of warp yarns passed by the loop portions to a warp density is between approximately 0.2 and 0.7, inclusive.

In other exemplary embodiments, the ratio of the average number of warp yarns passed by the loop portions to the average number of warp yarns passed by the connection portions is between approximately 6 and 24, inclusive.

Another aspect of exemplary embodiments is the thickness of the yarns used for the warp and weft yarns. Because the elastomeric (second) yarns will often be synthetic, they will be described herein using denier (den.), while the warp yarns and hard (first) weft yarns will be described using English cotton yarn number (Ne). Not withstanding the numbering system used to describe the yarns, a person of ordinary skill in the art will know how to convert from one system to the other, and would understand that the numbering system used in no way limits the properties and compositions of the yarns used.

Though not drawn to scale, it is illustrated in FIG. 1 that the warp, hard and elastomeric fibers can have different thicknesses, and it may be preferable that the elastomeric fibers have a smaller thickness than the hard fibers. In exemplary embodiments, it is preferred that the warp yarns are between approximately Ne 10 and Ne 40, inclusive. It is more preferred that the warp yarns are between approximately Ne 15 and Ne 25, inclusive. In exemplary embodiments it is preferred that the hard yarns are between approximately Ne 10 and Ne 70, inclusive. It is more preferred that the hard yarns be between approximately Ne 15 and Ne 50, inclusive. In exemplary embodiments it is preferred that the elastomeric yarns be between approximately 40 den. and 140 den., inclusive. It is more preferred that the elastomeric yarns be between approximately 60 den. and 80 den., inclusive.

By selecting the relative thicknesses of the yarns within the values of the inventive concept multiple benefits are achieved. For example, when the thickness of the hard weft yarns 106 is larger than that of the elastomeric weft yarns 105, the thicker loop portions 107*a* are better able to hide the under portions 109 from being seen and felt at the back of the fabric. The selection of correct yarn thicknesses also add to the knit-like feel and weight of the fabric.

FIGS. 2 and 3 show another way of looking at exemplary embodiments of the inventive concept. The fabric of exemplary embodiments can be thought of as a fabric 101 having a first weave 202 (shown in FIG. 2) and a second weave 203 (shown in FIG. 3). First weave 202 generally forms a front face of the fabric 102 and substantially comprises warp yarns 104 and elastomeric weft yarns 105 tightly woven in a predetermined arrangement. The second weave 203 generally forms a back face of the fabric 103 and substantially comprises warp yarns 104 and hard weft yarns 106 loosely woven in a predetermined arrangement such that the hard weft yarns 106 form alternately arranged under portions 107 and over portions 108 with respect to the warp yarns 104. The under portions 107 are formed when the hard weft yarns 106 pass along the backside 103 of the warp yarns 104 thereby defining loop portions 107*a*. The over portions 108 are formed when the hard weft yarns pass along the front side of the warp yarns 104, defining connection portions 108*a*. As depicted in FIG. 3, the number of warp yarns 104 passed by each loop portion 107*a* is 11, but in other exemplary embodiments the number may be different.

In FIG. 2, the first weave 202 is formed from elastomeric weft yarns 105 arranged in a predetermined arrangement with respect to the warp yarns 104 forming over portions 110 and under portions 109 in a weave that is tighter than the second weave 203.

In exemplary embodiments the second weave 203 substantially prevents the warp yarns 104 passed over by the elastomeric fibers 105 of the first weave 202 from being felt or seen from the back side 103 of the fabric 101.

Figure 4:
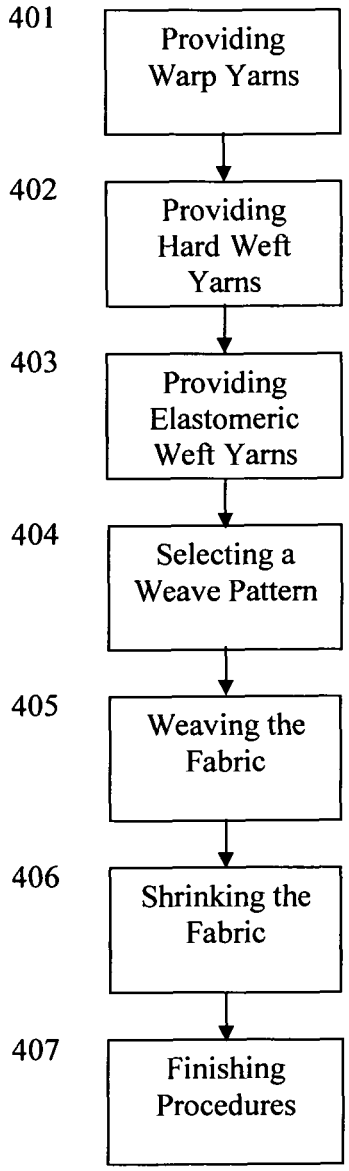
FIG. 4—A functional representation of a method of making a fabric according to an exemplary embodiment.

FIG. 4 represents a method of making a fabric according to an exemplary embodiment of the inventive concept. As illustrated in functional block 401, the first step of the process is providing warp yarns. The step can include selecting a thickness of the yarns, as well as determining the warp density. Determining other aspects of the warp yarns, known to those skilled in the art, can also be determined at this step. It will often be the case that this step will include the selection of indigo dyed warp yarns. The use of indigo dyed warp yarns will allow the resulting fabric to take advantage of many of the unique aspects of the indigo dyeing process. These aspects include, but are not limited to, the unique weathering effects that can be achieved with the ring dyed indigo yarns.

Functional block 402 is a step in which hard weft yarns are provided. Similar to step 401, this step can include determining all the aspects of the hard weft yarns known to those skilled in the art, including but not limited to: the thickness of the yarns, shrinkage ratio, elasticity, color, weft density, etc., the shrinkage ratio being that the elastomeric yarns are capable of greater shrinkage than the hard yarns. Functional block 403 represents a similar step with regards to the elastomeric weft yarns. In this step, all aspects of the elastomeric weft yarns can be selected.

Functional block 404 represents the step of determining a weave pattern. In this step, any weave pattern known to those skilled in the art can be selected, so long as at least one hard yarn is alternately arranged with at least one elastomeric yarn; ensuring the hard yarns pass alternately along the back side of the warp yarns in a predetermined number of warp yarns for each pass to form a series of over portions and under portions, and along the front side of the warp yarns a predetermined number of warp yarns for each pass to form hard over portions; the average number of warp yarns passed by each under portion is at least six; and the elastomeric yarns pass alternately along the back side of the warp yarns a predetermined number of warp yarns for each pass to form a series of elastomeric under portions, and along the front side of the warp yarns a predetermined number of warp yarns for each pass to form a series of elastomeric over portions.

Functional block 405 represents weaving the warp and weft yarns according to the selected weave pattern.

Functional block 406 represents the step of shrinking the fabric after weaving. During this shrinking the elastomeric yarns will shrink more than the hard yarns causing the under portions to become loop portions. Shrinking naturally occurs as soon as the fabric is removed from the weaving loom and the yarns are no longer under tension; further shrinking is carried out by wetting the fabric, during the finishing processes.

In exemplary embodiments, the loops portions are in substantially less tension than the over portions and under portions formed by the elastomeric yarns. In other exemplary embodiments the loops portions are in at least one of equilibrium and compression.

Other exemplary embodiments can add additional steps to the process of creating the fabric. These steps can include applying weathering effects to the finished fabric such as bleaching, hand scraping, sand blasting, stone washing and others known to those skilled in the art. These steps can include brushing either one of the front or back side of the fabric. The process can also include printing letters or graphics onto the fabric, or embroidering patterns and logos onto the fabric. The fabric can even be ripped and torn to meet the demands of current fashion trends. The process can also include tailoring the fabric into garments, or other steps known to those skilled in the art.

Figure 5:
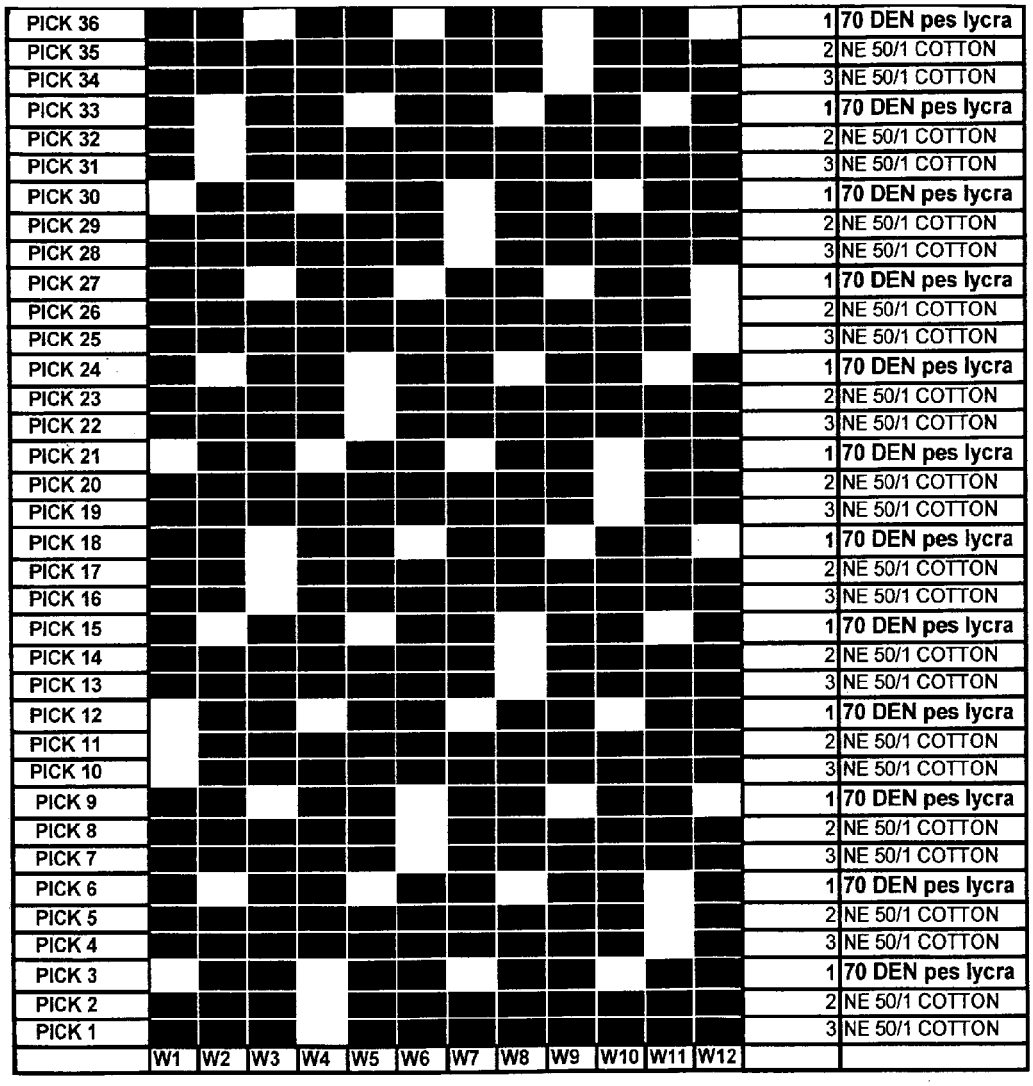
FIG. 5—A weave report for an exemplary embodiment as described in Example 1 below.
Figure 7:
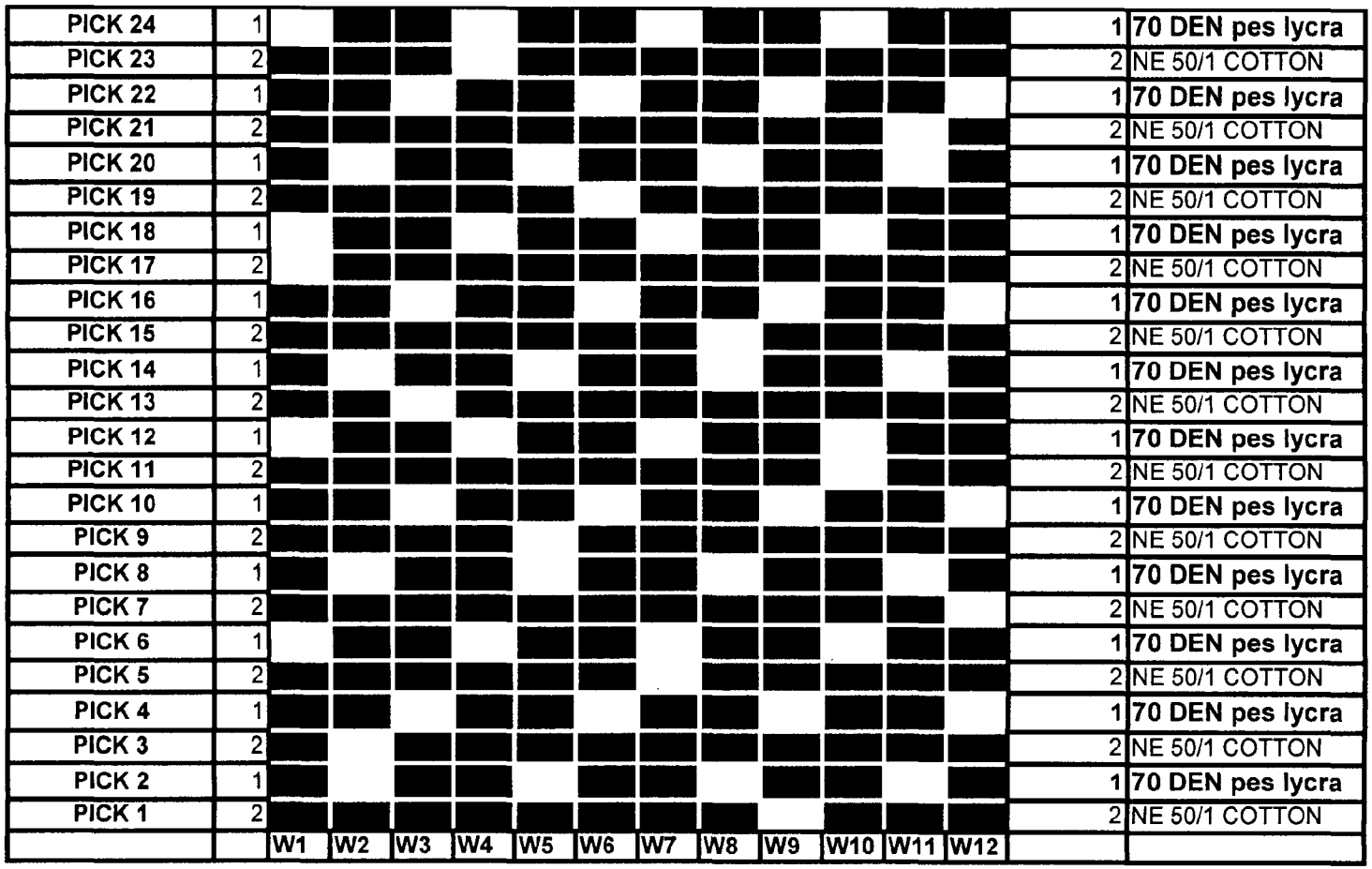
FIG. 7—A weave report for an exemplary embodiment as described in Example 3 below.
Figure 9:
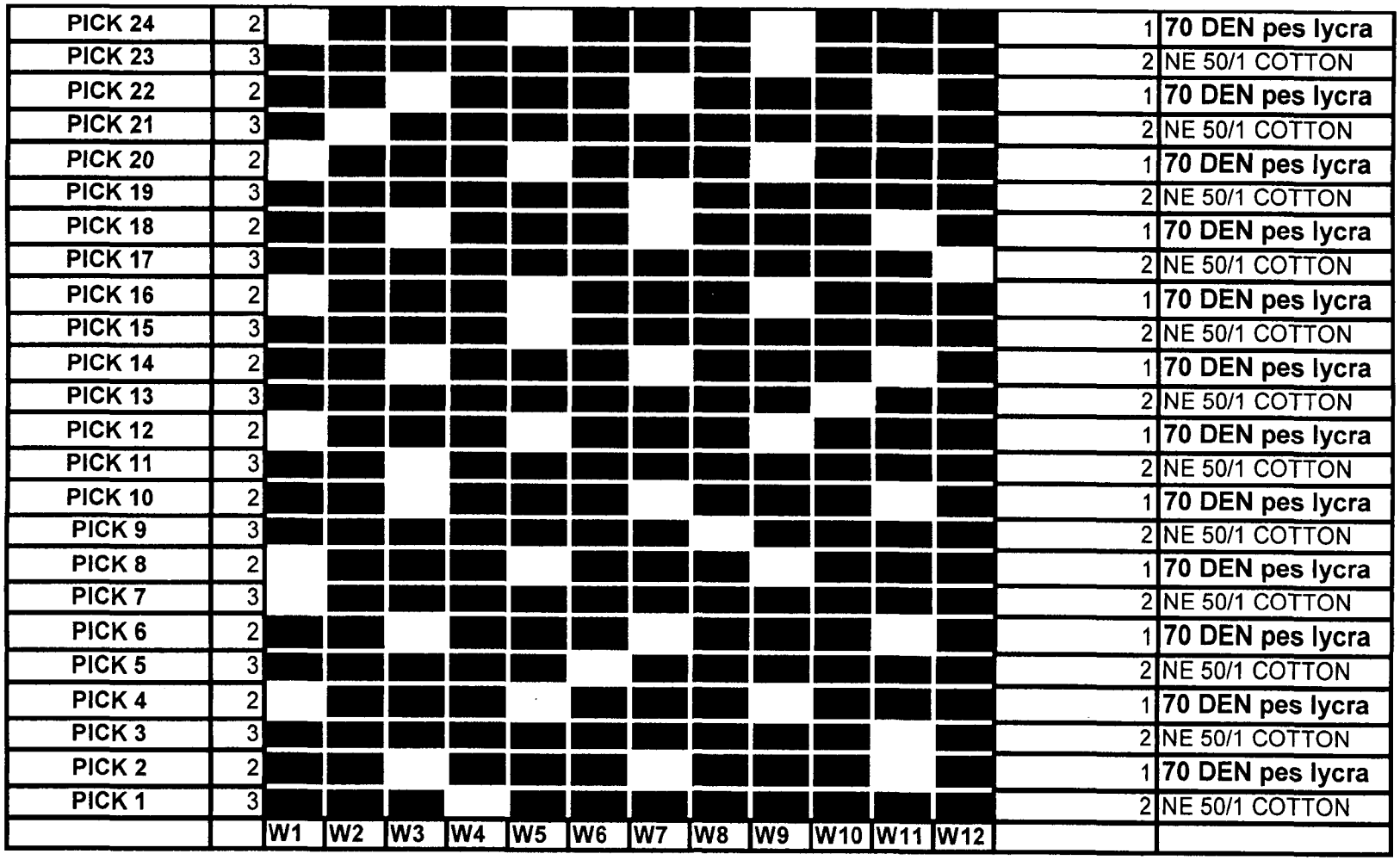
FIG. 9—A weave report for an exemplary embodiment as described in Example 5 below.
Figure 11:
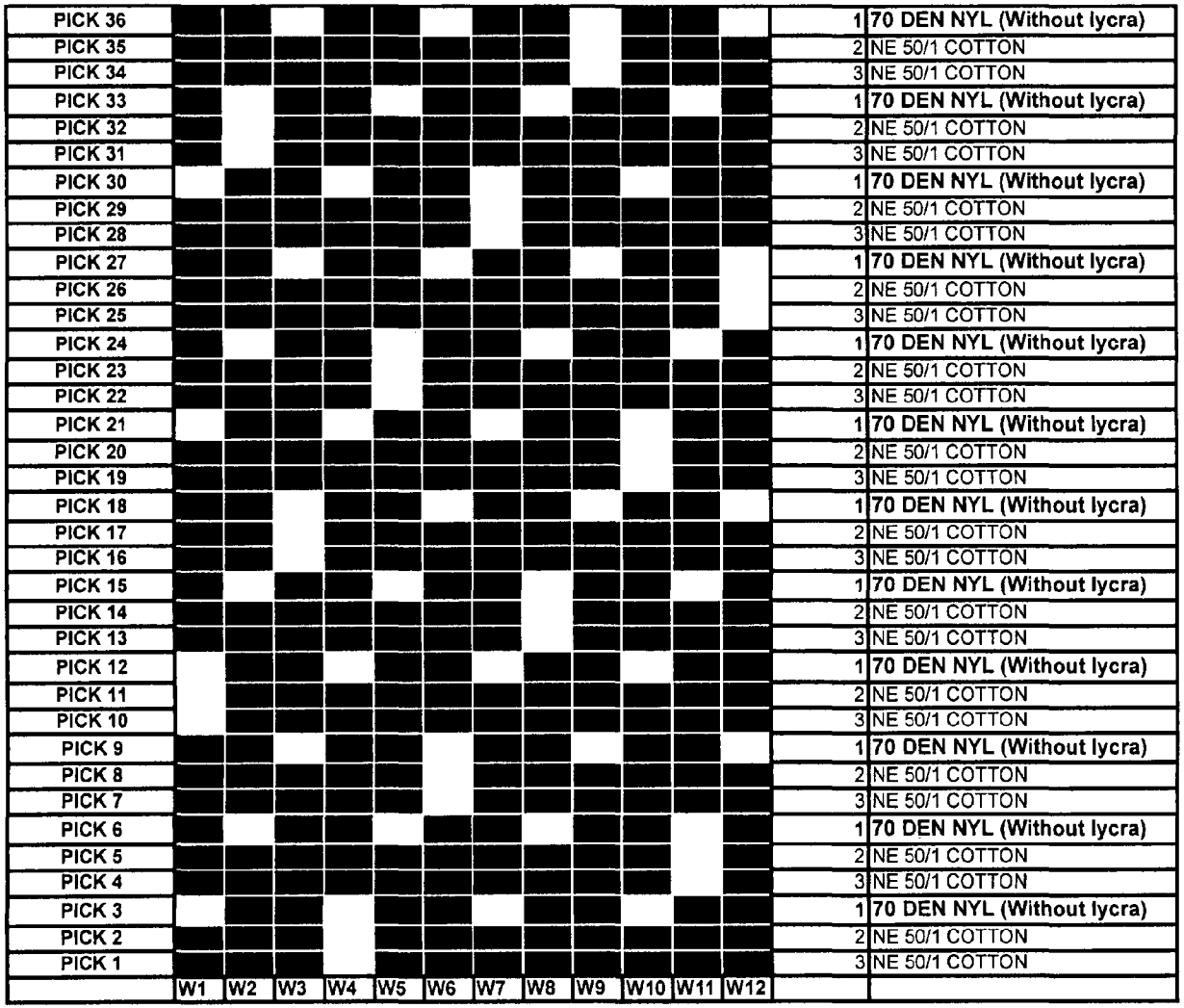
FIG. 11—A weave report for an exemplary embodiment as described in Example 7 below.
Figure 12:
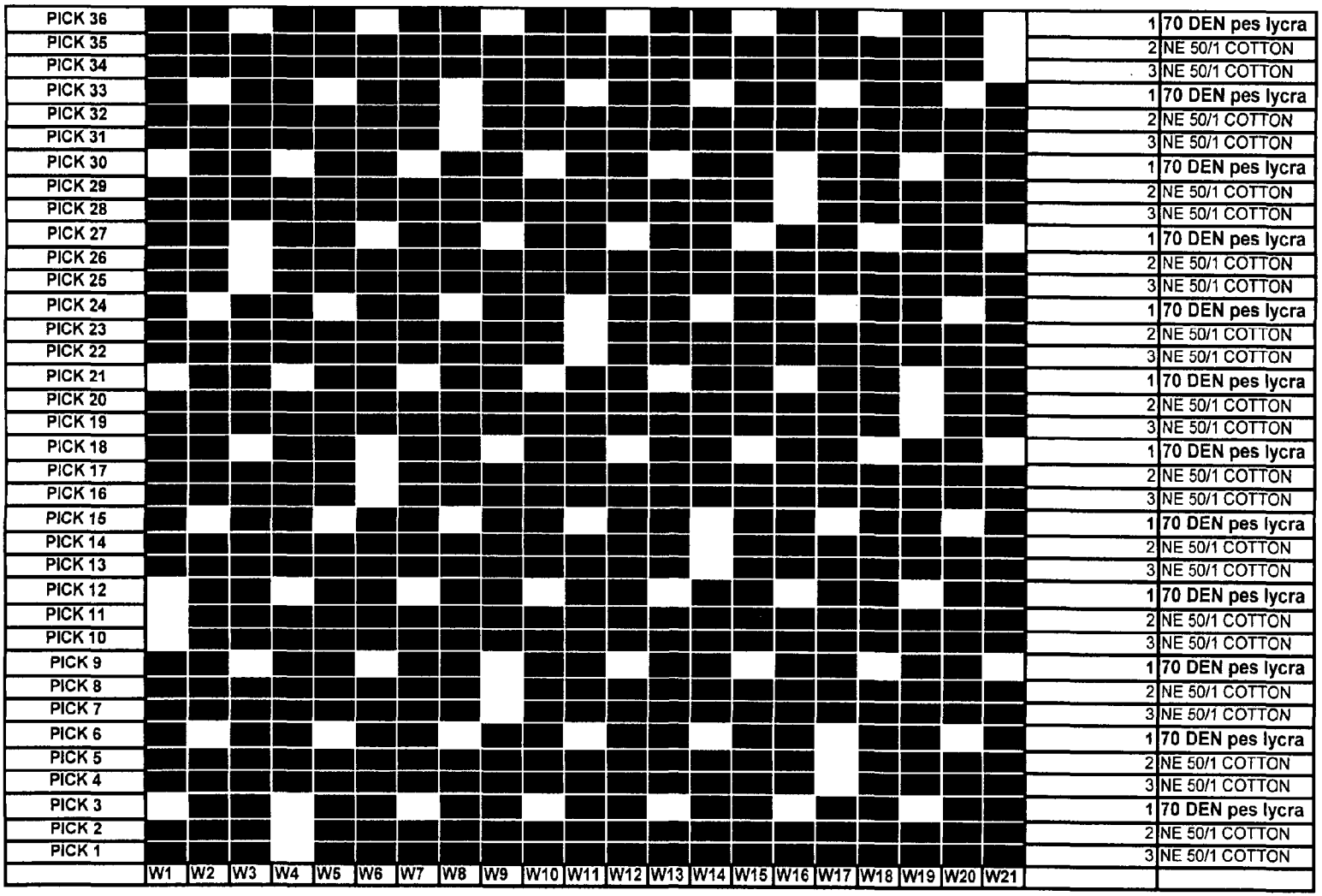
FIG. 12—A weave report for an exemplary embodiment as described in Example 8 below.
Figure 15:
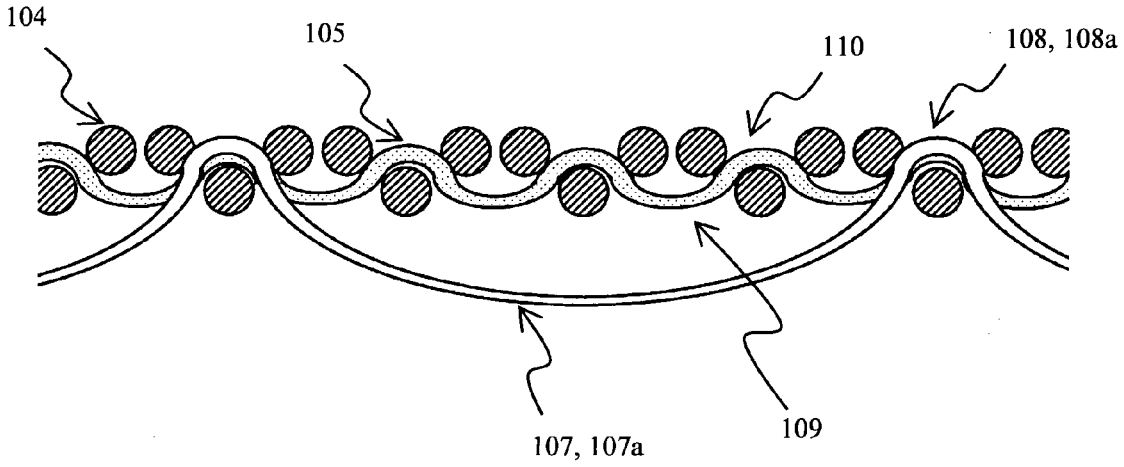
FIG. 15—A cross-sectional view of a fabric of an exemplary embodiment.

What follows next are very specific examples of exemplary embodiments according to the inventive concept. The inventive concept is capable of other and different embodiments without deviating from the scope and spirit of the inventive concept. The examples should be considered illustrative in nature and not as restrictive. They are illustrated with reference to the weave reports of FIGS. 5-14; as is known to the skilled person, a weave report is a graphic rendition of the minimum repeat unit (unitary portion) of the fabric. This means that picks and warps will repeat the pattern shown by the weave report. As example, in FIG. 5, pick 37 will be identical to pick 1, pick 38 to pick 2 and so on, the same applying to the warps:W13 is identical to W1 and so on.

Example 1

The result of this exemplary embodiment is a knitted fabric having the weight and feel of a knitted t-shirt, but doing so with indigo dyed yarns which will allow for the application of abrasion effects previously only available at great cost. The warp yarns, weft yarns, warp density, weft density and loom set-up were chosen according to the values in Table 1. These selections gave the resulting fabric a weight of approximately 5-7 oz/sqyd (170-240 g/cm$^2$). The weave pattern was selected according to the weave report depicted in FIG. 5. A dobby-type weaving loom with a weft selection system was used to perform the weaving.

TABLE 1

| Sample | Warp Yarn | Elastomeric Weft Yarn | Hard Weft Yarn | Warp Density | Weft Density | Fabric Weight | Warps passed by "Loop" Portion |
|---|---|---|---|---|---|---|---|
| Example 1 | Ne 20/1 Ring spun 100% cotton, indigo dyed yarn | 70 Denier polyester + 40 Denier Lycra (with 3:5 draft | Ne 50/1 Combed 100% cotton Yarn | 27 ends/cm in weaving reed | 54 picks/cm in loom state fabric, 61.5 picks/cm finished fabric | 5-7 oz/sqyd | 11 |

TABLE 1-continued

| Sample | Warp Yarn | Elastomeric Weft Yarn | Hard Weft Yarn | Warp Density | Weft Density | Fabric Weight | Warps passed by "Loop" Portion |
|---|---|---|---|---|---|---|---|
| | | ratio) intermingled yarn | | | | | |
| Example 2 | Ne 20/1 Ring spun 100% cotton yarn | 70 Denier Polyester + 40 Denier Lycra (with 3.5 draft ratio) intermingled yarn | Yarn 2:Ne 50/1 Combed 100% cotton yarn | 27 ends/cm in weaving reed | 54 pick/cm in loom state fabric 61.5 picks/cm when fabric finished | 5-7 oz/sqyd | 11 |
| Example 3 | Ne 20/1 Ring spun 100% cotton yarn | 70 Denier Polyester + 40 Denier Lycra (with 3.5 draft ratio) intermingled yarn | Ne 50/1 Combed 100% cotton yarn | 27 ends/cm in weaving reed | 54 pick/cm in loom state fabric 61.5 picks/cm when fabric finished | 5-7 oz/sqyd | 11 |
| Example 4 | Ne 20/1 Ring spun 100% cotton yarn | 70 Denier Polyester + 40 Denier Lycra (with 3.5 draft ratio) intermingled yarn | Ne 50/1 Combed 100% cotton yarn | 27 ends/cm in weaving reed | 54 pick/cm in loom state fabric 61.5 picks/cm when fabric finished | 5-7 oz/sqyd | 11 |
| Example 5 | Ne 20/1 Ring spun 100% cotton yarn | 70 Denier Polyester + 40 Denier Lycra (with 3.5 draft ratio) intermingled yarn | Ne 50/1 Combed 100% cotton yarn | 27 ends/cm in weaving reed | 54 pick/cm in loom state fabric 61.5 picks/cm when fabric finished | 5-7 oz/sqyd | 11 |
| Example 6 | Ne 20/1 Ring spun 100% cotton yarn | 70 Denier Polyester + 40 Denier Lycra (with 3.5 draft ratio) intermingled yarn | Ne 50/1 Combed 100% cotton yarn | 27 ends/cm in weaving reed | 54 pick/cm in loom state fabric 61.5 picks/cm when fabric finished | 5-7 oz/sqyd | 11 |
| Example 7 | Ne 20/1 Ring spun 100% cotton yarn | 70 Denier 100% Nylon yarn | Ne 50/1 Combed 100% cotton yarn | 27 ends/cm in weaving reed | 54 pick/cm in loom state fabric 61.5 picks/cm when fabric finished | 5-7 oz/sqyd | 11 |
| Example 8 | Ne 20/1 Ring spun 100% cotton yarn | 70 Denier Polyester + 40 Denier Lycra (with 3.5 draft ratio) intermingled yarn | Ne 50/1 Combed 100% cotton yarn | 27 ends/cm in weaving reed | 54 pick/cm in loom state fabric 61.5 picks/cm when fabric finished | 5-7 oz/sqyd | 20 |
| Example 9 | Ne 20/1 Ring spun 100% | Denier Polyester + 40 | 150 Denier 100% | 27 ends/cm in weaving | 42.2 pick/cm in loom state | 8 oz/sqyd (270 g/cm$^2$) | 11 |

TABLE 1-continued

| Sample | Warp Yarn | Elastomeric Weft Yarn | Hard Weft Yarn | Warp Density | Weft Density | Fabric Weight | Warps passed by "Loop" Portion |
|---|---|---|---|---|---|---|---|
| | cotton yarn | Denier Lycra (with 3.5 draft ratio) intermingled yarn | micro Polyester yarn | reed | fabric 48.2 picks/cm when fabric finished | | |
| Example 10 | Ne 20/1 Ring spun 100% cotton yarn | Denier Polyester + 40 Denier Lycra (with 3.5 draft ratio) intermingled yarn | Ne 16/1 ring 100% % cotton yarn | 27 ends/cm in weaving reed | 42.2 pick/cm in loom state fabric 48.2 picks/cm when fabric finished | ~10 oz/sqyd (340 g/cm$^2$) | 11 |

After weaving, the fabric was wetted and stretched in the length (warp) direction. When this happens, the fabric shrinks in the width (weft) direction, the Lycra™ (elastane) yarn pulling the warn yarns together. Because the cotton weft yarns contain no elastane, they do not shrink as much as the Lycra yarns, and the cotton yarn floats on the back of the fabric formed long loops which cover most of the back side of the fabric. After shrinking, the fabric was heat set to reduce shrinking in further garment washings.

The resulting fabric had the weight and feel of a knitted fabric, including the much softer feel generally associated with knitted fabrics. At the same time, the indigo warp yarns gave the warp side fabric the look and qualities of a denim fabric, such as denim's ability to take on finishing effects, such as abrasion effects. The back side of the fabric was white in color due to the un-dyed weft yarns, and was extremely soft due to the long loops created thereon. A person wearing a garment made from the fabric is prevented from feeling the uncomfortable polyester weft yarns by the long loops that dominate the back side of the fabric. The long loops also prevent the indigo from coming into contact with the skin of a person wearing the garment, preventing the indigo dye from running if the person sweats.

Due at least in part to the selection of the weave and elastomeric weft yarns, the resulting fabric had very high elastic properties. These properties included the ability to stretch in all directions, not just the weft direction.

Example 2

The result of this example is a knitted fabric having the weight and feel of a knitted fabric. The warp yarns, weft yarns, warp density, weft density and loom set-up were chosen according to the values in Table 1. The weave pattern was selected according to the weave report depicted in FIG. 6. Examination of the weave report shows that the ratio of elastomeric yarns to hard yarns is 2:1, as opposed to 1:2 in Example 1. The ratio of over portions of elastomeric yarn/hard yarn is 4:1, i.e. the number of up and down movements of the elastomeric yarn (references 1 and 2 in the second column from left) are 4 times the number of up and down movements of the hard yarn (ref 3 in above mentioned column).

Example 3

The result of this example is a knitted fabric having the weight and feel of a knitted fabric. The warp yarns, weft yarns, warp density, weft density and loom set-up were chosen according to the values in Table 1. The weave pattern was selected according to the weave report depicted in FIG. 7. Examination of the weave report shows that the ratio of elastomeric yarns to hard yarns is 1:1, as opposed to 1:2 in Example 1.

The ratio of over portions of elastomeric yarn/hard yarn is 4:1, i.e. the number of up and down movements of the elastomeric yarn (references 1 in the second column from left) are 4 times the number of up and down movements of the hard yarn (ref 2 in above mentioned column).

Example 4

The result of this example is a knitted fabric having the weight and feel of a knitted fabric. The warp yarns, weft yarns, warp density, weft density and loom set-up were chosen according to the values in Table 1. The weave pattern was selected according to the weave report depicted in FIG. 8. As can be seen in the weave report, the weave on the front side of the fabric is herring bone, and the number of warps passed by the elastomeric weft yarns (ref 1 in second column from right) need not be the same throughout the weave. For example, the number of warp yarns passed by the weft yarn at pick 27 is different than the numbers passed by the weft yarn at pick 21. Therefore, the ratio of over portions of elastomeric yarn/hard yarn is 2:1, 3:1 and 4:1, according to the picks (references 1 in the second column from left).

Example 5

The result of this example is a knitted fabric having the weight and feel of a knitted fabric. The warp yarns, weft yarns, warp density, weft density and loom set-up were chosen according to the values in Table 1. The weave pattern was selected according to the weave report depicted in FIG. 9; the ratio of over portions of elastomeric yarn (ref.1) to hard yarn (ref.2) is 3:1. This example makes use another exemplary embodiment of a weave pattern.

Example 6

The result of this example is a knitted fabric having the weight and feel of a knitted fabric. The warp yarns, weft yarns, warp density, weft density and loom set-up were chosen according to the values in Table 1. The weave pattern was selected according to the weave report depicted in FIG. 10; the ratio of over portions of elastomeric yarn (ref.1) to hard yarn (ref.2) is 3:1. This example makes use another exemplary embodiment of a weave pattern.

Example 7

The result of this example is a knitted fabric having the weight and feel of a knitted fabric. The warp yarns, weft yarns, warp density, weft density and loom set-up were chosen according to the values in Table 1. The weave pattern was selected according to the weave report depicted in FIG. 11; the ratio of over portions of elastomeric yarn (ref.1) to hard yarn (ref.2) is 4:1. As can be seen the values depicted in Table 1, this example makes use of synthetic weft yarns that do not include Lycra.

Example 8

The result of this example is a knitted fabric having the weight and feel of a knitted fabric. The warp yarns, weft yarns, warp density, weft density and loom set-up were chosen according to the values in Table 1. The weave pattern was selected according to the weave report depicted in FIG. 12. As can be seen in the weave pattern of FIG. 12, the under portions of the hard weft yarns pass 20 warp yarns. The ratio of over portions of elastomeric yarn (ref.1) to hard yarn (ref.2) is 7:1.

Example 9

The result of this example is a knitted fabric having the weight and feel of a knitted fabric. The warp yarns, weft yarns, warp density, weft density and loom set-up were chosen according to the values in Table 1. The weave pattern was selected according to the weave report depicted in FIG. 13; the ratio of over portions of elastomeric yarn (ref.1) to hard yarn (ref.2 or 3) is 4:1. As can be seen in Table 1, the hard weft yarn of this example is a polyester yarn. As a result of these polyester yarns, the resulting fabric has a higher weight than the previous example. Embodiments such as Example 9, as well as the other examples, can include brushing the back side of the fabric.

Example 10

The result of this example is a knitted fabric having the weight and feel of a knitted fabric. The warp yarns, weft yarns, warp density, weft density and loom set-up were chosen according to the values in Table 1. The weave pattern was selected according to the weave report depicted in FIG. 14; the ratio of over portions of elastomeric yarn (ref.1) to hard yarn (ref.2 or 3) is 4:1. As can be seen in Table 1, a heavier cotton hard weft yarn is used, resulting in the heavier fabric weight of this example.

The invention claimed is:

1. A method for producing a fabric, the method comprising:

providing warp yarns;

providing hard weft yarns;

providing elastomeric weft yarns, the elastomeric weft yarns having a shrinkage ratio greater than the shrinkage ratio of the hard weft yarns;

selecting a weave pattern wherein:

the weave pattern of the hard yarns is different from the weave pattern of the elastomeric yarns, at least one hard weft yarn is alternately arranged with at least one elastomeric weft yarn, the hard weft yarns pass alternately along a back side of the warp yarns a predetermined number of warp yarns for each pass to form a series of hard under portions, and along a front side of the warp yarns a predetermined number of warp yarns for each pass to form hard over portions, and for each hard weft yarn, an average number of warp yarns passed by each under portion is at least 6, and the elastomeric weft yarns pass alternately along the back side of the warp yarns a predetermined number of warp yarns for each pass to form a series of elastomeric under portions, and along the front side of the warp yarns a predetermined number of warp yarns for each pass to form a series of elastomeric over portions, said hard over portions being formed when said hard weft yarns pass along a front side of the warp yarns and defining connection portions, said connection portions being exposed to a front face of the fabric coinciding with the front side of the warp yarns;

weaving the fabric according to the selected pattern wherein the connection portions of adjacent hard yarns form a pattern extending in a diagonal direction with respect to the warp yarns, the elastomeric weft yarns, and the hard weft yarns; and removing the woven fabric from a loom, whereby the fabric is no longer under tension and shrinks, and the elastomeric weft yarns shrink more than the hard weft yarns causing the hard under portions that extend to cover at least 6 warp yarns to form loop portions, the loop portions being located only on an opposed back face of the fabric, wherein the loop portions of adjacent hard yarns form a pattern extending in a diagonal direction with respect to the warp yarns, the elastomeric weft yarns, and the hard weft yarns, wherein the hard yarns are inelastic yarns and the elastomeric weft yarns are elastic and retain elasticity after said shrinking.

2. The method according to claim 1 further comprising performing at least one from among a bleaching, hand scraping, sand blasting, stone washing, printing graphics, printing lettering, embroidering, brushing and abrasion on the fabric.

3. The method according to claim 1 further comprising tailoring the fabric into a garment such that the back face of the fabric comprises an inside of the garment.

4. The method according to claim 1, wherein the warp yarns are indigo-dyed.

5. The method according to claim 1, wherein the elastomeric weft yarns are elastane.

6. The method according to claim 1, wherein the number of warp yarns passed by each of the loop portions is at least 6 times the number of warp yarns passed by the connection portions.

7. The method according to claim 1, wherein the loop portions are in substantially less tension than the over and under portions formed by the elastomeric yarns.

8. The method according to claim 1, wherein the loop portions are in at least one of equilibrium and compression.

9. The method according to claim 1, wherein the fabric stretches in a diagonal direction with respect to the warp yarns and weft yarns.

10. The method according to claim 1, wherein the weave pattern of the elastomeric yarns is a twill pattern.

11. The method according to claim 1, wherein for each hard weft yarn, the average of warp yarns passed by each under portion is at least 11.

12. The method according to claim 1, wherein after three home washes the fabric comprises a warp density between approximately 25 and 80 warps/cm.

13. The method according to claim 1, wherein after the weaving, but before the shrinking the fabric comprises a warp density between approximately 25 and 60 warps/cm.

14. The method according to claim 1, wherein after three home washes the fabric comprises a warp density between approximately 30 and 65 warps/cm, inclusive.

15. The method according to claim 1, wherein after the weaving, but before the shrinking the fabric comprises a warp density between approximately 30 and 50 warps/cm.

16. The method according to claim 1, wherein after three home washes the fabric comprises a warp density between approximately 35 and 55 warps/cm, inclusive.

17. The method according to claim 1, wherein after the weaving, but before the shrinking the fabric comprises a weft density between 30 and 90 wefts/cm, inclusive.

18. The method according to claim 1, wherein after three home washes the fabric comprises a weft density between approximately 35 and 95 wefts/cm, inclusive.

19. The method according to claim 1, wherein after the weaving, but before the shrinking the fabric comprises a weft density between approximately 40 and 80 wefts/cm, inclusive.

20. The method according to claim 1, wherein after three home washes the fabric comprises a weft density between approximately 45 and 85 wefts/cm, inclusive.

21. The method according to claim 1, wherein after the weaving, but before the shrinking the fabric comprises a weft density between approximately 50 and 70 wefts/cm.

22. The method according to claim 1, wherein after three home washes the fabric comprises a weft density between approximately 55 and 75 wefts/cm, inclusive.

23. The method according to claim 1, wherein in the warp yarns have an English cotton number between approximately Ne 10 and Ne 30, inclusive.

24. The method according to claim 1, wherein the hard yarns have an English cotton number between approximately Ne 10 and Ne 70, inclusive.

25. The method according to claim 24, wherein the hard yarns have an English cotton number between approximately Ne 15 and Ne 50, inclusive.

26. The method according to claim 1, wherein the elastomeric yarns have a denier between approximately 40 and 140 denier, inclusive.

27. The method according to claim 1, wherein a stretching ratio of said elastomeric weft yarns is at least 10% greater than a stretching ratio of said hard weft yarns.

28. The method according to claim 1, wherein the ratio of warp yarns passed by the loop portion to the connection portion is between approximately 6:1 and 24:1, inclusive.

29. The method according to claim 1, wherein the ratio of elastomeric yarns to hard yarns is between approximately 2:1 and 1:5, inclusive.

30. The method according to claim 1, wherein the ratio of elastomeric yarns to hard yarns is between approximately 1:2 and 1:3, inclusive.

31. The method according to claim 1, wherein for a corresponding amount of warp yarns in a weave report the ratio of the number of over portions obtained by an up and down movement of an elastomeric yarn is 2 to 12 times the amount of over portions obtained by an up and down movement of a hard yarn.

32. The method according to claim 1, wherein the elastomeric under portions are substantially covered by the loop portions, wherein the elastomeric under portions are obscured when the fabric is in a relaxed state.

33. The method according to claim 1, wherein the loop portions prevent the warp yarns passed over by the connection portions from contacting a surface covered by the fabric.

34. The method according to claim 1, wherein the ratio of the average number of warp yarns passed by the loop portions to a warp density is between approximately 0.2 and 0.7, inclusive.

35. The method according to claim 1, wherein the ratio of the average number of warp yarns passed by the loop portions to the average number of warp yarns passed by the connection portions is between 10 and 24, inclusive.

36. The method according to claim 1, wherein, for each hard weft yarn, the average of warp yarns passed by each under portion is at most 24.

37. A method for producing a fabric, the method comprising:

providing warp yarns;

providing hard weft yarns, wherein the hard weft yarns have an English cotton number between approximately Ne 10 and Ne 70, inclusive;

providing elastomeric weft yarns, the elastomeric weft yarns having a shrinkage ratio greater than the shrinkage ratio of the hard weft yarns;

selecting a weave pattern wherein:

at least one hard weft yarn is alternately arranged with at least one elastomeric weft yarn, the hard weft yarns pass alternately along a back side of the warp yarns a predetermined number of warp yarns for each pass to form a series of hard under portions, and along a front side of the warp yarns a predetermined number of warp yarns for each pass to form hard over portions, for each hard weft yarn, an average number of warp yarns passed by each under portion is at least 6, and the elastomeric weft yarns pass alternately along the back side of the warp yarns a predetermined number of warp yarns for each pass to form a series of elastomeric under portions, and along the front side of the warp yarns a predetermined number of warp yarns for each pass to form a series of elastomeric over portions;

weaving the fabric according to the selected pattern;

shrinking the woven fabric wherein the elastomeric weft yarns shrink more than the hard weft yarns causing the hard under portions to form loop portions, said hard over portions define connection portions, said connection portions being exposed to a front face of the fabric coinciding with the front side of the warp yarns, wherein the loop portions or the connection portions of adjacent hard yarns form a pattern extending in a diagonal direction with respect to the warp yarns, the elastomeric weft yarns, and the hard weft yarns, the elastomeric weft yarns are elastic and retain elasticity after said shrinking, and tailoring the fabric into a garment such that a back face of the fabric opposite the front face of the fabric, comprises an inside of the garment.

38. The method according to claim 37, wherein the loop portions are located only on the back face of the fabric opposite the front face.

39. The method according to claim 37, wherein, for each hard weft yarn, the average of warp yarns passed by each under portion is at least 11.

40. The method according to claim 37, wherein the hard weft yarns are inelastic yarns.

41. A method for producing a fabric, the method comprising:

providing warp yarns;

providing hard weft yarns having an English cotton number between approximately Ne 10 and Ne 70, inclusive;

providing elastomeric weft yarns, the elastomeric weft yarns having a shrinkage ratio greater than the shrinkage ratio of the hard weft yarns;

selecting a weave pattern wherein:

at least one hard weft yarn is alternately arranged with at least one elastomeric weft yarn, the hard weft yarns pass alternately along a back side of the warp yarns a predetermined number of warp yarns for each pass to form a series of hard under portions, and along a front side of the warp yarns a predetermined number of warp yarns for each pass to form hard over portions, and for each hard weft yarn, an average number of warp yarns passed by each under portion is at least 11, and the elastomeric weft yarns pass alternately along the back side of the warp yarns a predetermined number of warp yarns for each pass to form a series of elastomeric under portions, and along the front side of the warp yarns a predetermined number of warp yarns for each pass to form a series of elastomeric over portions, said hard over portions being formed when said hard weft yarns pass along a front side of the warp yarns and defining connection portions, said connection portions being exposed to a front face of the fabric coinciding with the front side of the warp yarns;

weaving the fabric according to the selected pattern;

shrinking the woven fabric wherein the elastomeric weft yarns shrink more than the hard weft yarns causing the hard under portions to form loop portions located only on an opposed back face of the fabric; and after said shrinking, performing home washing at least three times, wherein, after three home washes the fabric comprises a weft density between about 35 and 95 wefts/cm, and a warp density between about 35 and 55 warps/cm, inclusive.

42. The method according to claim 41, wherein the hard weft yarns are inelastic yarns.

* * * * *